US007540447B2

(12) United States Patent
Shiraishi et al.

(10) Patent No.: US 7,540,447 B2
(45) Date of Patent: Jun. 2, 2009

(54) BRAKING FORCE CONTROL METHOD AND DEVICE FOR STRIP-SHAPED MATERIAL FEEDING DEVICE

(75) Inventors: Yoshihide Shiraishi, Noda (JP); Hiromitsu Ebihara, Toride (JP)

(73) Assignee: Komori Corporation, Tokyo (JP)

( * ) Notice: Subject to any disclaimer, the term of this patent is extended or adjusted under 35 U.S.C. 154(b) by 435 days.

(21) Appl. No.: 11/116,369

(22) Filed: Apr. 28, 2005

(65) Prior Publication Data

US 2005/0242224 A1 Nov. 3, 2005

(30) Foreign Application Priority Data

Apr. 30, 2004 (JP) ..... 2004-136128

(51) Int. Cl.
*B65H 23/06* (2006.01)

(52) U.S. Cl. ..... 242/421; 242/421.4; 242/421.7

(58) Field of Classification Search ..... 242/421, 242/421.1, 421.4, 421.7–421.8
See application file for complete search history.

(56) References Cited

U.S. PATENT DOCUMENTS

| | | | | |
|---|---|---|---|---|
| 2,902,232 | A * | 9/1959 | Jacobsen | 242/421.4 |
| 3,465,981 | A | 9/1969 | Byrt | |
| 3,822,838 | A * | 7/1974 | Butler et al. | 242/417.2 |
| 3,936,008 | A * | 2/1976 | Crum | 242/421.1 |
| 4,151,594 | A * | 4/1979 | Stern | 242/421.1 |
| 4,199,118 | A * | 4/1980 | Tetro et al. | 242/421.1 |
| 4,278,213 | A * | 7/1981 | Rubruck | 242/420.2 |
| 4,286,757 | A * | 9/1981 | Wirth | 242/421.1 |
| 6,405,098 | B1 * | 6/2002 | Mehlis et al. | 700/139 |
| 6,408,757 | B2 * | 6/2002 | Ogawa et al. | 101/480 |

FOREIGN PATENT DOCUMENTS

| | | | |
|---|---|---|---|
| DE | 2855591 | A1 | 6/1980 |
| EP | 0054697 | A1 | 6/1982 |
| JP | 58-59150 | A | 4/1983 |
| JP | 62-012302 | | 1/1987 |
| JP | 6-227722 | A | 8/1994 |
| JP | 7-61661 | A | 3/1995 |

* cited by examiner

*Primary Examiner*—Sang Kim
(74) *Attorney, Agent, or Firm*—Birch, Stewart, Kolasch & Birch, LLP

(57) ABSTRACT

In a feeding device comprising turret arms having spindle shafts for supporting a web roll, an air brake for applying a braking force in a rotating direction to the spindle shafts, and an accelerating motor for applying a drive force in the rotating direction to the spindle shafts and a braking force in the rotating direction to the spindle shafts, a braking force control device has a tension control device which exercises control such that if a braking force required for the spindle shafts is lower than a constant value, only the braking force from the accelerating motor is supplied to the spindle shafts, and that if the braking force required for the spindle shafts is higher than the constant value, the braking force from the accelerating motor is supplied to the spindle shafts, and the braking force of the air brake is supplied to the spindle shafts.

14 Claims, 23 Drawing Sheets

BRAKING FORCE CONTROL METHOD AND DEVICE FOR STRIP-SHAPED MATERIAL FEEDING DEVICE

CROSS REFERENCE TO RELATED APPLICATION

The entire disclosure of Japanese Patent Application No. 2004-136128 filed on Apr. 30, 2004, including specification, claims, drawings and summary, is incorporated herein by reference in its entirety.

BACKGROUND OF THE INVENTION

1. Field of the Invention

This invention relates to a braking force control method and device for a strip-shaped material feeding device, which are preferred when applied to a feeding device or the like of a rotary printing press.

2. Description of the Related Art

Examples of a braking device in a feeding device of an offset rotary press include those as shown in FIGS. 22 and 23 (see Japanese Patent Application Laid-Open No. 1995-61661; hereinafter referred to as patent document 1).

In the printing press, a web roll 103 is rotatably supported between a pair of turret arms 100*a* and 100*b* via a taper cone 101 and a mechanical chuck 102. According to the braking device, the web roll 103 is braked by an air brake 104 when tension is controlled in a routine operation or when the printing press comes to a sudden stop. The air brake 104 is of an ordinary type pressing brake pads 108, which are supplied with pressurized air controlled by an electro-pneumatic regulator 107, against opposite side surfaces of a brake disk 106 secured onto a rotating shaft 105 supporting the web roll 103, thereby applying a braking force in a rotating direction to the rotating shaft 105.

In tension control during a routine operation, for example, a control torque command according to the diameter of the web roll 103, which has been computed, is outputted by a sequencer 109, as an air pressure, to the air brake 104 via the electro-pneumatic regulator 107 to give tension to a web W rolled off. Based on a value detected by a tension sensor 111 (detects the tight side of tension) in a tension roller 110 and a position detected by a potentiometer 113 (detects the loose side of tension) in a dancer roller 112, feedback control is exercised.

Alternatively, as described in Japanese Patent Application Laid-Open No. 1994-227722 (hereinafter referred to as patent document 2), the regenerative braking force of a web accelerating motor, as well as the braking force of the braking device, is utilized such that the braking force of the braking device is used as a main braking force, and the regenerative braking force of the web accelerating motor is used as an aid only when the required braking force is greater than the braking force of the braking device.

With the braking device of patent document 1, the air brake 104 is actuated for tension control during a routine operation, or at the time of sudden shutdown of the printing press. Thus, the properties of the brake are changed by the surface deterioration of the brake pad 108 due to change with time or the carbonization of the brake pad 108 due to heat generation. As a result, variations occur in the control output-torque characteristics (see FIG. 4(*b*)) of the air brake 104, thus making accurate control impossible. Also, periodical inspection and replacement of the brake pad 108 become necessary. This has posed the problems that an operator is burdened and the efficiency of work is decreased.

With the braking device of patent document 2 as well, drawbacks similar to those of patent document 1 occur when the braking force of the air brake is used as the main braking force. That is, the properties of the brake are changed by the surface deterioration of the brake pad due to change with time or the carbonization of the brake pad due to heat generation. As a result, variations occur in the control output-torque characteristics (see FIG. 4(*c*)) of the air brake, thus making accurate control impossible. Also, periodical inspection and replacement of the brake pad become necessary. This has posed the problems of burdening the operator and decreasing the work efficiency.

In the braking device of patent document 2, it is conceivable to use only the regenerative braking force of the web accelerating motor, for the purpose of tension control during a routine operation, or at the time of sudden shutdown of the printing press. In this case, a motor with a very high capacity is required, presenting the unexpected problem of poor economy.

SUMMARY OF THE INVENTION

The present invention has been accomplished in light of the above-described problems with the earlier technologies. The present invention provides a braking force control method and device for a strip-shaped material feeding device, which can ensure high accuracy braking force control satisfactorily during long-term use, without imposing a burden on the operator or increasing costs, by effectively switching between braking means such as an air brake and driving means such as an accelerating motor.

To attain the foregoing, there is provided, according to an aspect of the present invention, a braking force control method for a strip-shaped material feeding device, including a braking force control device, arranged to feed a strip-shaped material of a web roll, the strip-shaped material feeding device comprising web roll support means having a rotating shaft for supporting the web roll, brake means for applying a braking force in a rotating direction to the rotating shaft, and drive means for applying a drive force in the rotating direction to the rotating shaft and a braking force in the rotating direction to the rotating shaft, the braking force control method comprising:

supplying only the braking force from the drive means to the rotating shaft if the braking force required for the rotating shaft is smaller than a predetermined value; and supplying the braking force from the drive means to the rotating shaft, and supplying the braking force of the brake means to the rotating shaft, if the braking force required for the rotating shaft is larger than the predetermined value.

In the braking force control method, the predetermined value may be a maximum value of the braking force from the drive means.

In the braking force control method, the predetermined value may be equal to or larger than a maximum value of a braking force required for tension control of the strip-shaped material in a routine operation.

The braking force control method may further comprise supplying the braking force from the drive means to the rotating shaft, and supplying a braking force from the brake means to the rotating shaft by an amount corresponding to a difference between the braking force required for the rotating shaft and a maximum value of the braking force from the drive means, if the braking force required for the rotating shaft is larger than the maximum value of the braking force from the drive means.

In the braking force control method, the strip-shaped material feeding device may be a strip-shaped material continuous feeding device for connecting a strip-shaped material of a new web roll to the strip-shaped material being fed, and continuously feeding a strip-shaped material, the brake means may be an air brake, and the drive means may be a motor of an accelerating device for the new web roll, the accelerating device being arranged to accelerate a peripheral speed of the strip-shaped material of the new web roll to a speed of the strip-shaped material being fed.

In the braking force control method, the braking force required for the rotating shaft may be calculated from a diameter of the web roll.

In the braking force control method, the braking force required for the rotating shaft may be calculated from a set value of reference tension setting means and a signal from tension detecting means for detecting a tension of the strip-shaped material.

According to another aspect of the present invention, there is provided a braking force control device of a strip-shaped material feeding device arranged to feed a strip-shaped material of a web roll, the strip-shaped material feeding device comprising web roll support means having a rotating shaft for supporting the web roll, brake means for applying a braking force in a rotating direction to the rotating shaft, and drive means for applying a drive force in the rotating direction to the rotating shaft and a braking force in the rotating direction to the rotating shaft, the braking force control device comprising a control device which exercises control in such a manner as to supply only the braking force from the drive means to the rotating shaft if the braking force required for the rotating shaft is smaller than a predetermined value, and supply the braking force from the drive means to the rotating shaft, and supply the braking force of the brake means to the rotating shaft, if the braking force required for the rotating shaft is larger than the predetermined value.

In the braking force control device, the control device may set the predetermined value at a maximum value of the braking force from the drive means.

In the braking force control device, the control device may set the predetermined value at a value equal to or larger than a maximum value of a braking force required for tension control of the strip-shaped material in a routine operation.

In the braking force control device, the control device may exercise control in such a manner as to supply the braking force from the drive means to the rotating shaft, and supply a braking force from the brake means to the rotating shaft by an amount corresponding to a difference between the braking force required for the rotating shaft and a maximum value of the braking force from the drive means, if the braking force required for the rotating shaft is larger than the maximum value of the braking force from the drive means.

In the braking force control device, the strip-shaped material feeding device may be a strip-shaped material continuous feeding device for connecting a strip-shaped material of a new web roll to the strip-shaped material being fed, and continuously feeding a strip-shaped material, the brake means may be an air brake, and the drive means may be a motor of an accelerating device for the new web roll, the accelerating device being arranged to accelerate a peripheral speed of the strip-shaped material of the new web roll to a speed of the strip-shaped material being fed.

In the braking force control device, the control device may calculate the braking force required for the rotating shaft from a signal from web roll diameter detecting means for detecting a diameter of the web roll.

In the braking force control device, the control device may calculate the braking force required for the rotating shaft from a set value of reference tension setting means and a signal from tension detecting means for detecting a tension of the strip-shaped material.

According to the present invention with the above-described features, the frequency of operation of the brake means such as an air brake can be kept to a minimum, management of brake pads, etc. can be facilitated, high accuracy control of a braking force can be ensured satisfactorily during long-term use, and a burden on the operator can be lessened. Furthermore, the capacity of the drive means such as an accelerating motor may be relatively low, because the brake means such as an air brake is used as an aid. Moreover, the drive means may be an existing accelerating motor or the like. Thus, large increases in the costs are avoided.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

A braking force control method and device for a strip-shaped material feeding device according to the present invention will now be described in detail by embodiments with reference to the accompanying drawings, which in no way limit the invention.

EMBODIMENT 1

Figure 1:
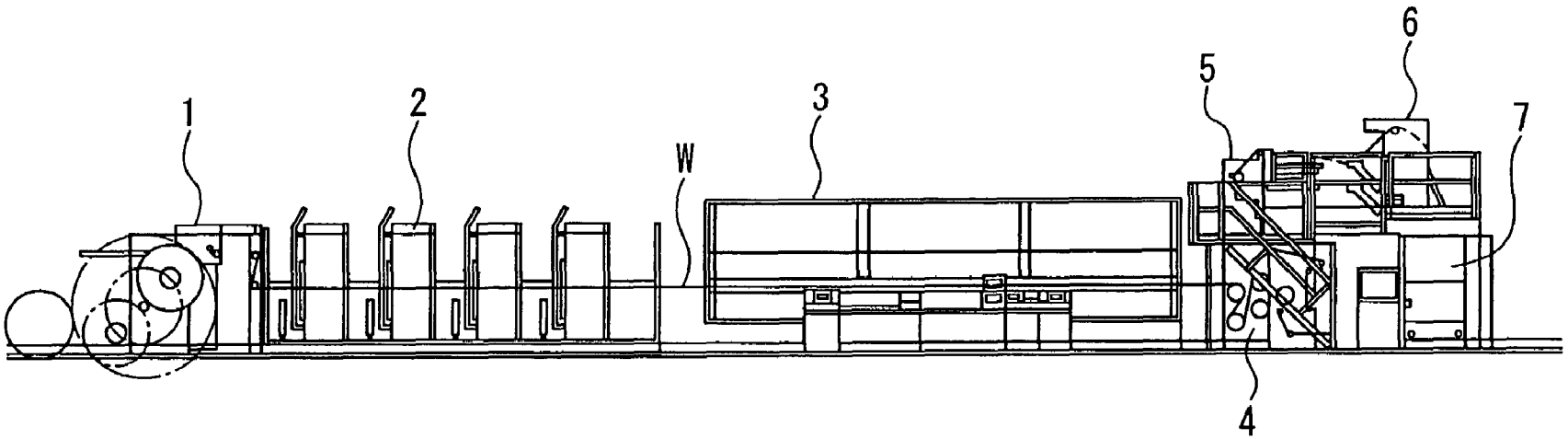
FIG. 1 is a schematic view of an offset rotary press showing Embodiment 1 of the present invention.
Figure 2:
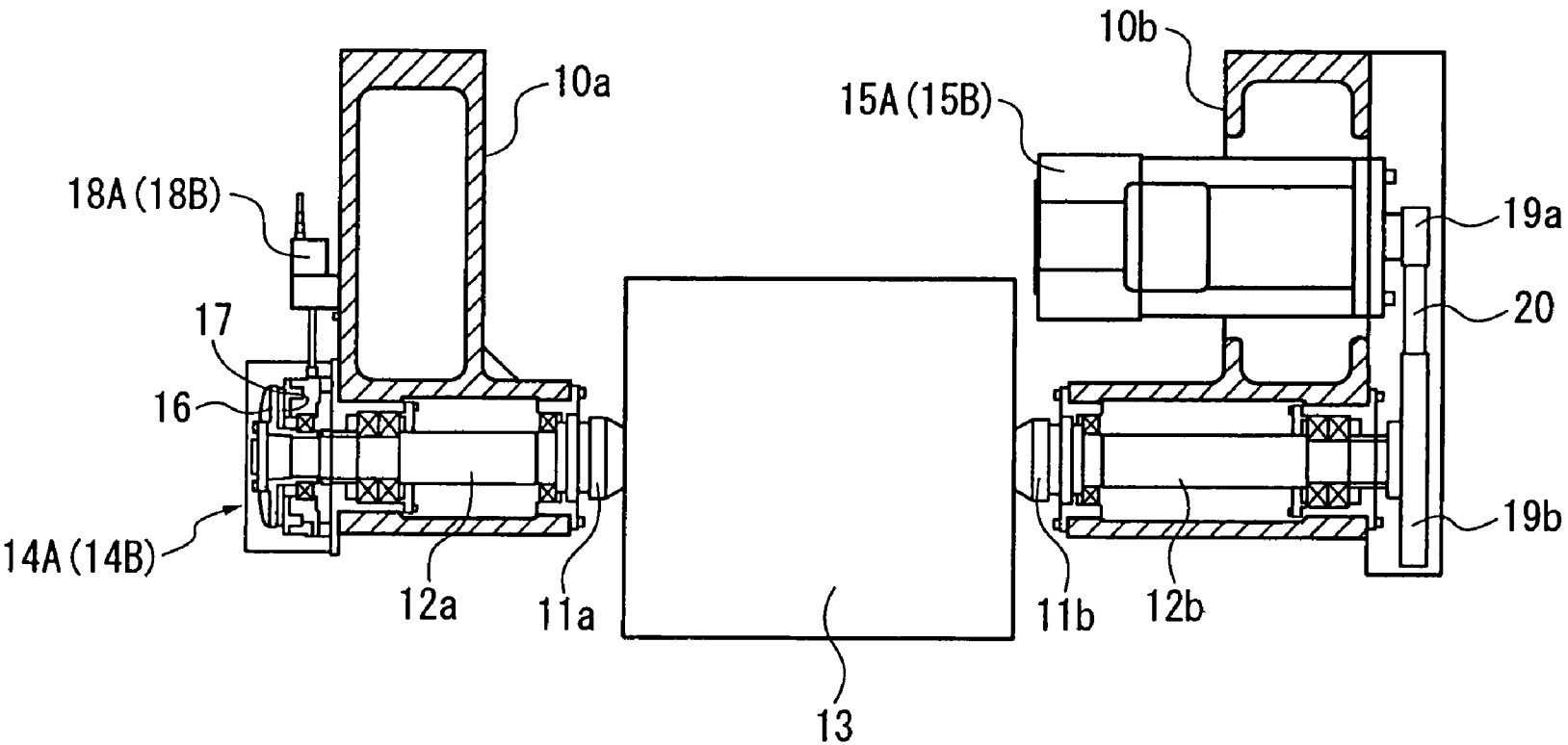
FIG. 2 is a sectional view of essential parts of a feeding device.
Figure 3:
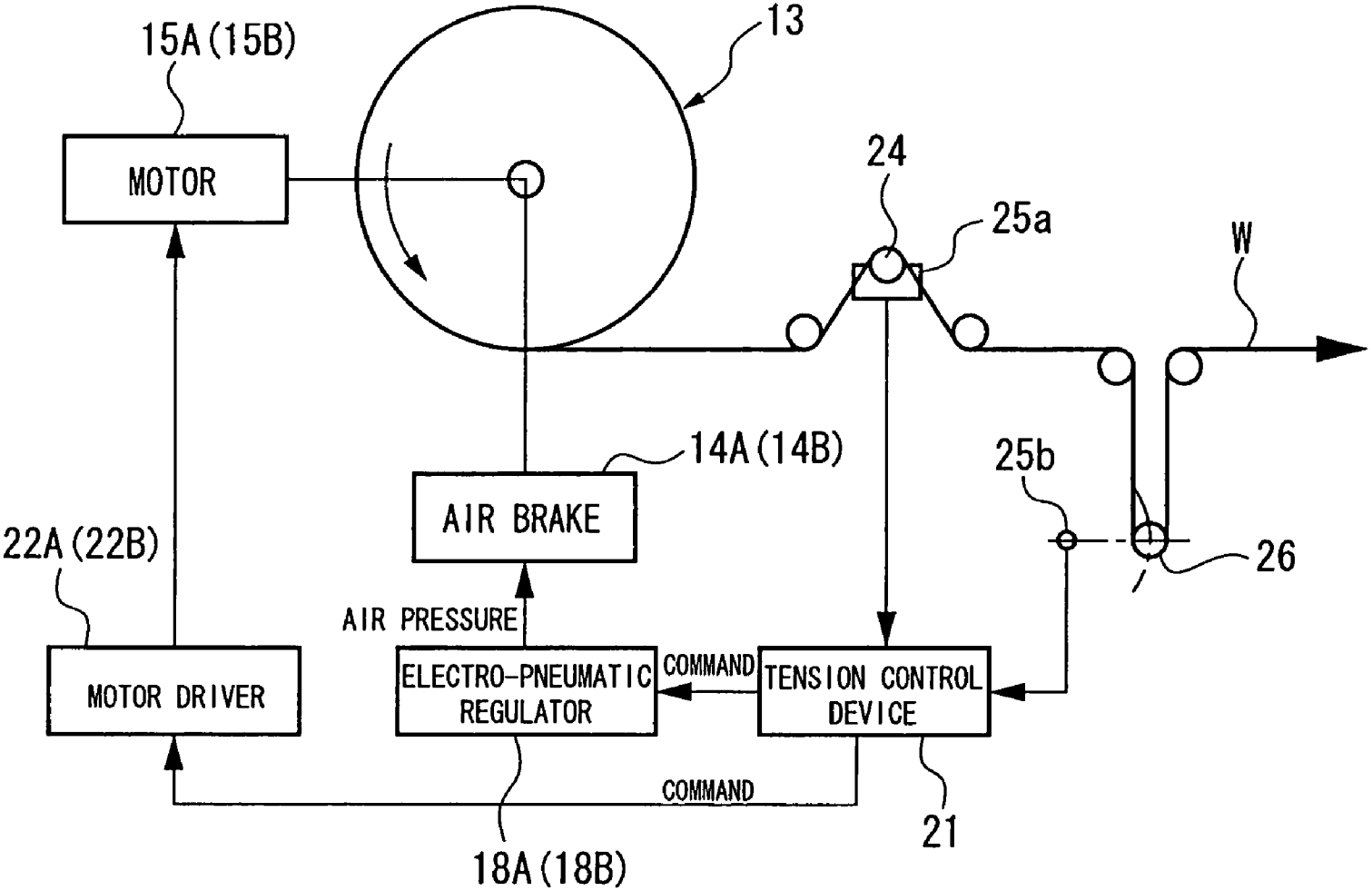
FIG. 3 is a schematic constitutional drawing of a braking force control device.
Figure 4:
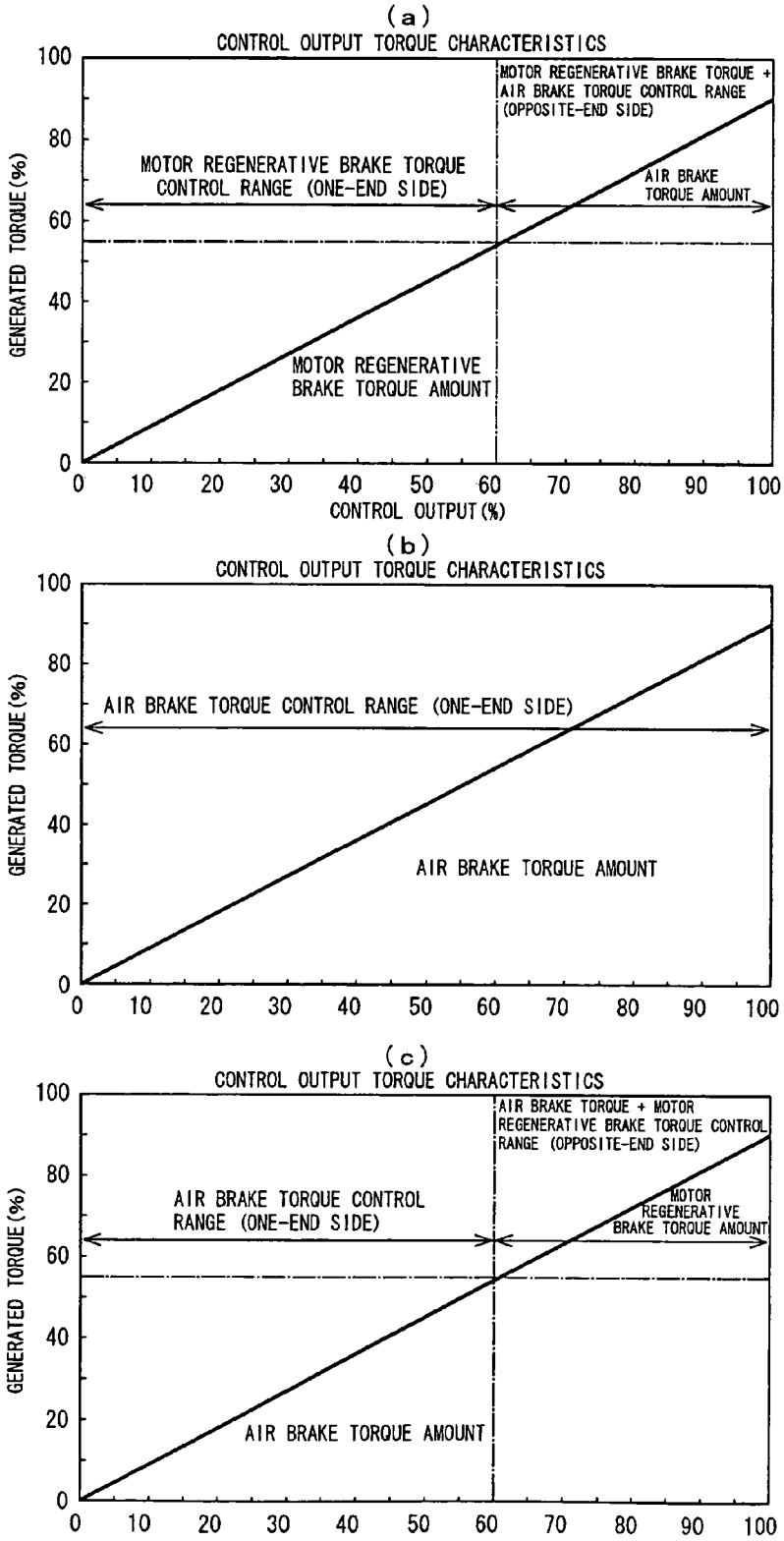
FIGS. 4(*a*) to 4(*c*) are comparative explanation drawings of the control output-torque characteristics of the present invention versus earlier technologies.
Figure 5:
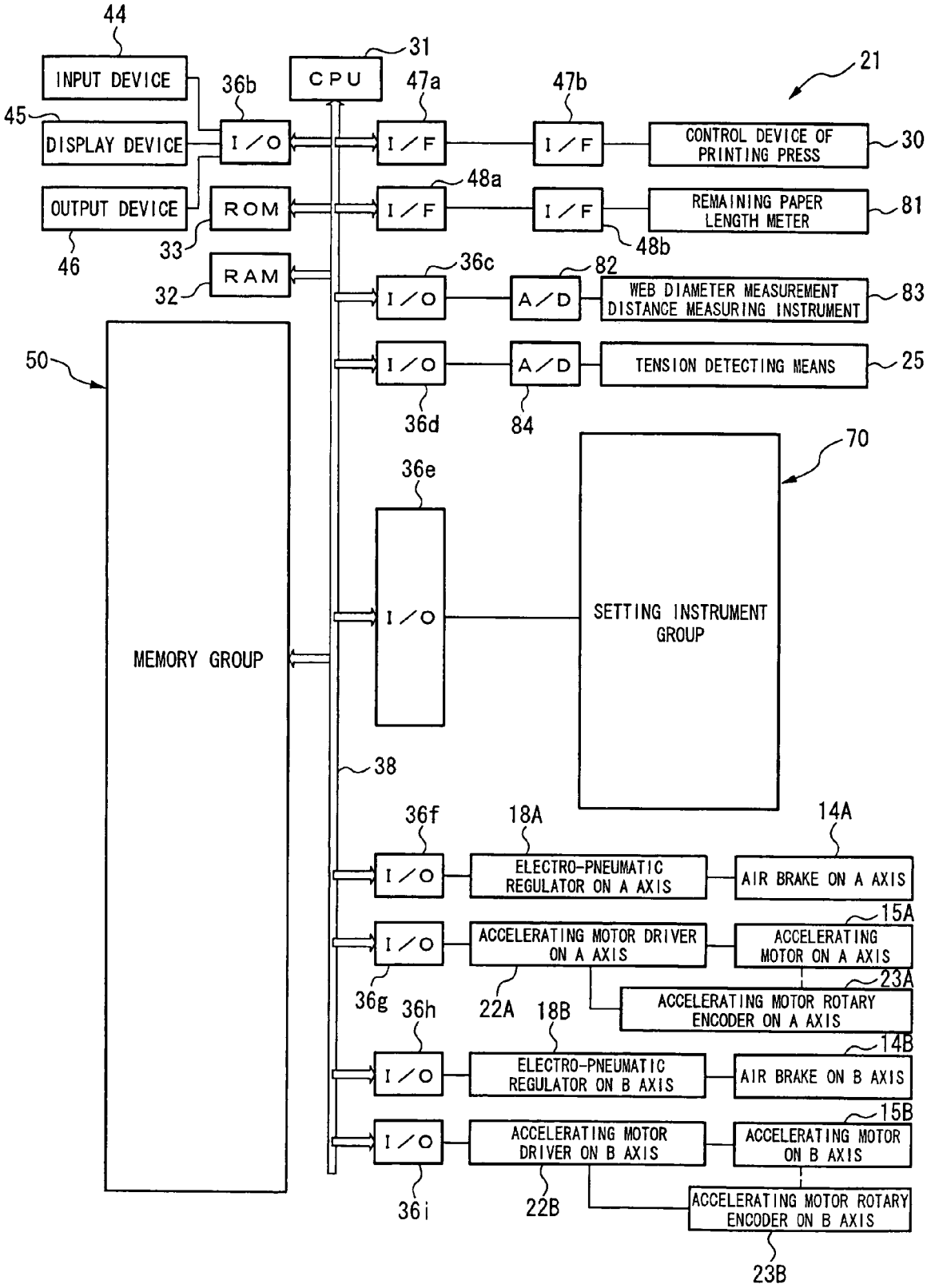
FIG. 5 is a block diagram of a tension control device.
Figure 6:
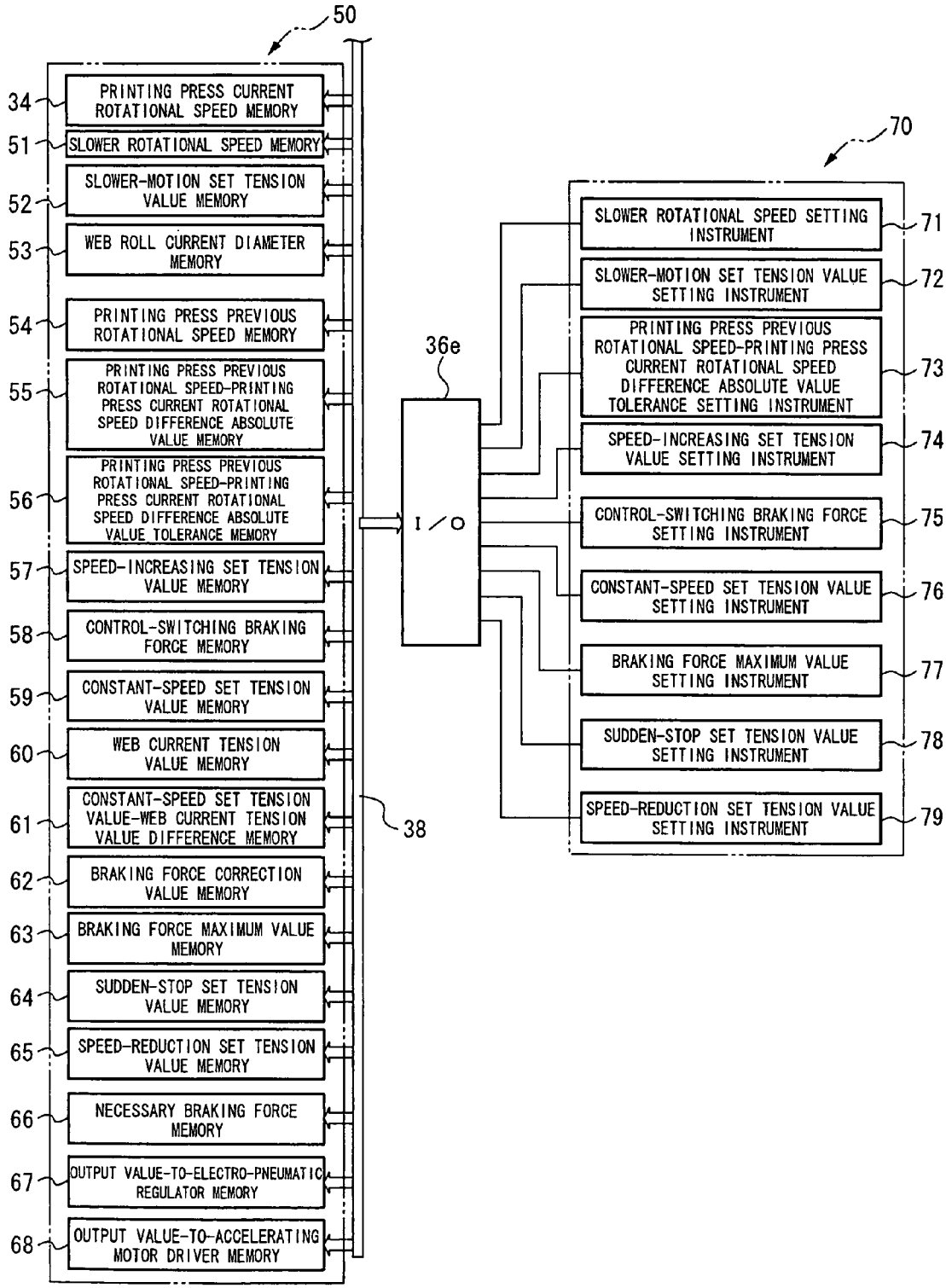
FIG. 6 is a detail drawing of essential parts of FIG. 5.
Figure 7:
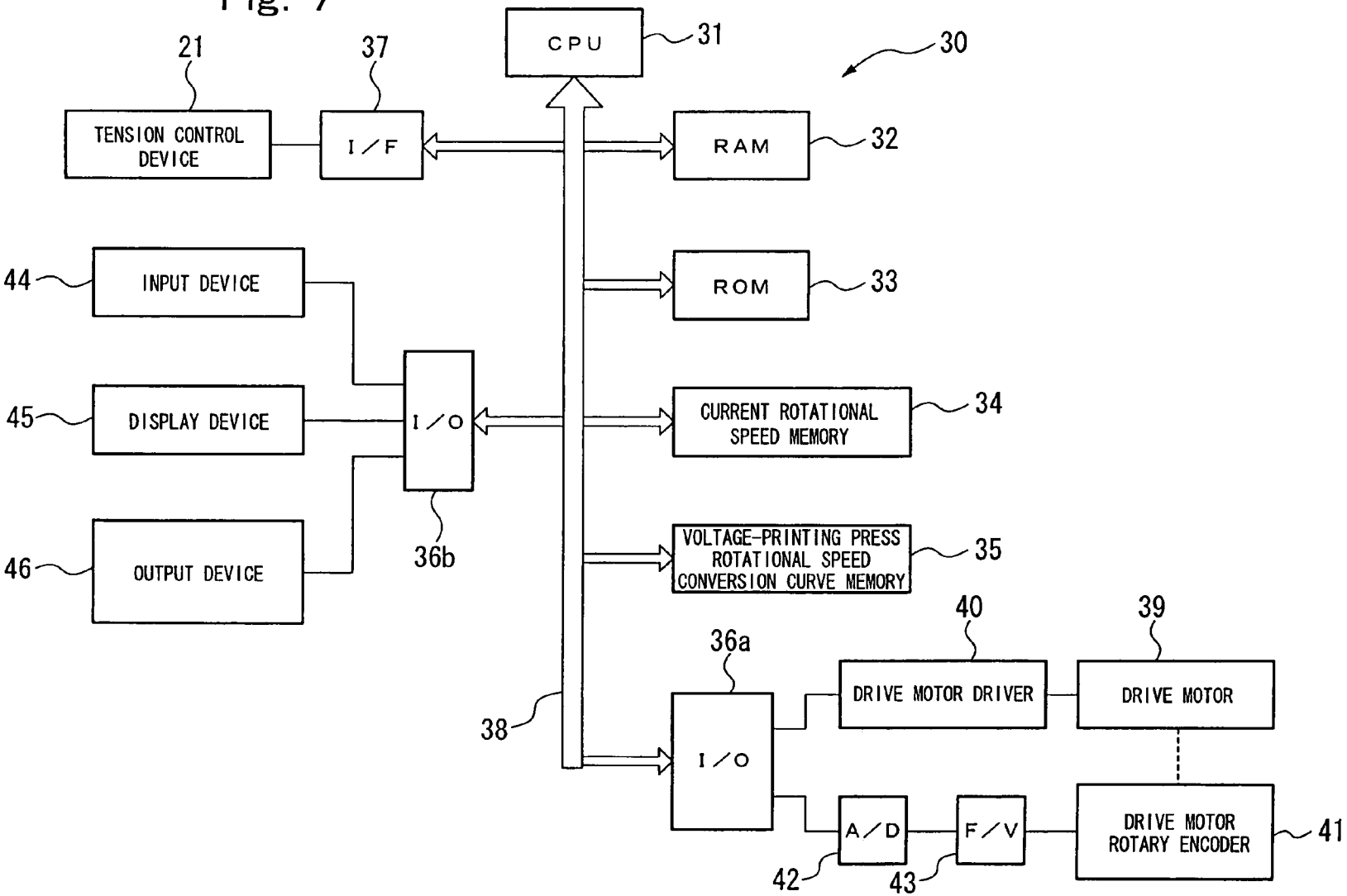
FIG. 7 is a block diagram of a control device of the printing press.
Figure 14:
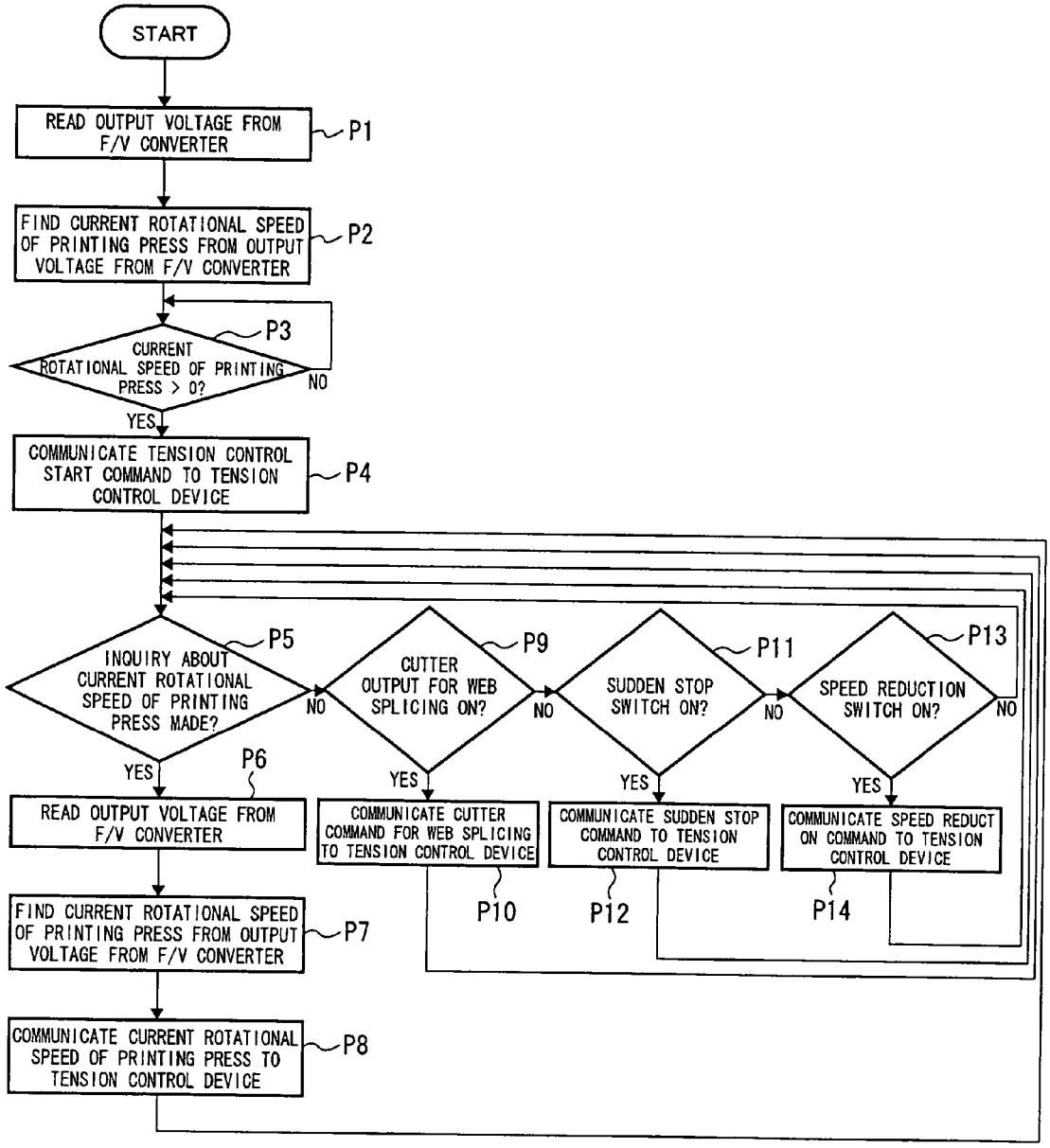
FIG. 14 is an action flow chart for the control device of the printing press.
Figure 15:
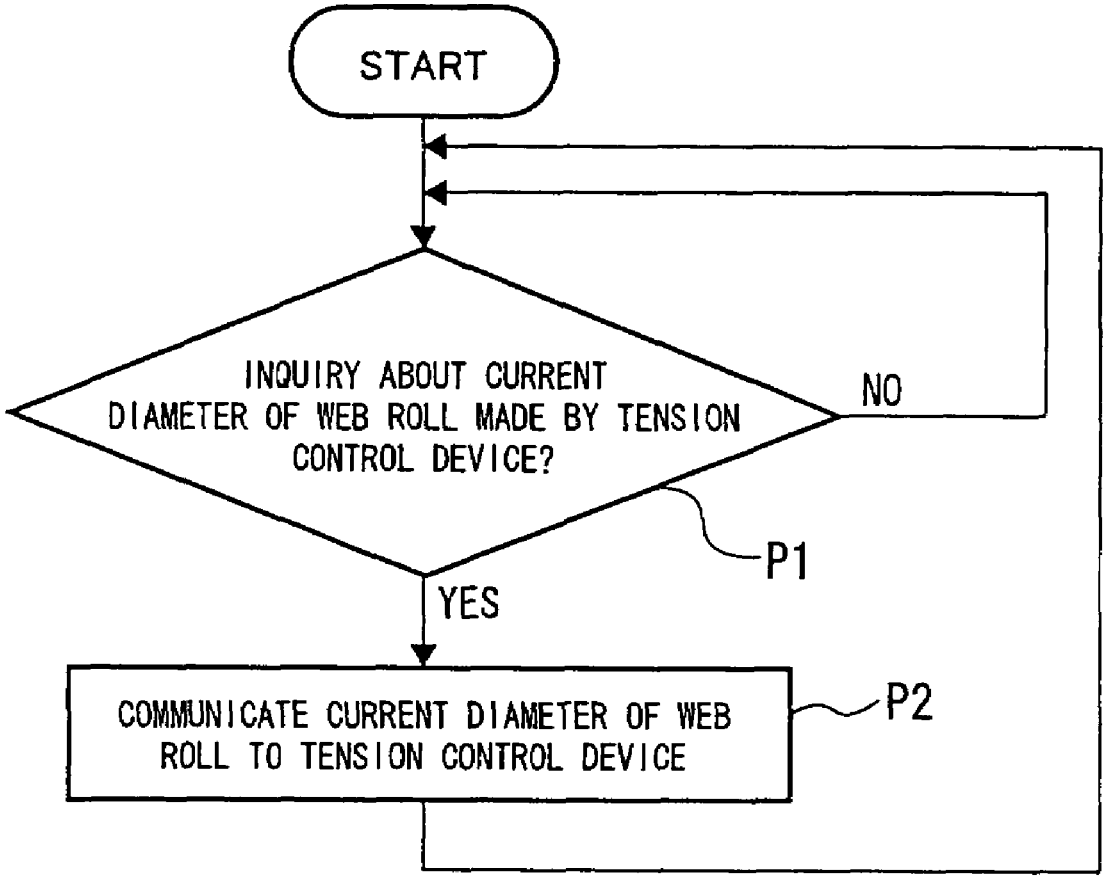
FIG. 15 is an action flow chart for a remaining paper length meter.
Figure 16:
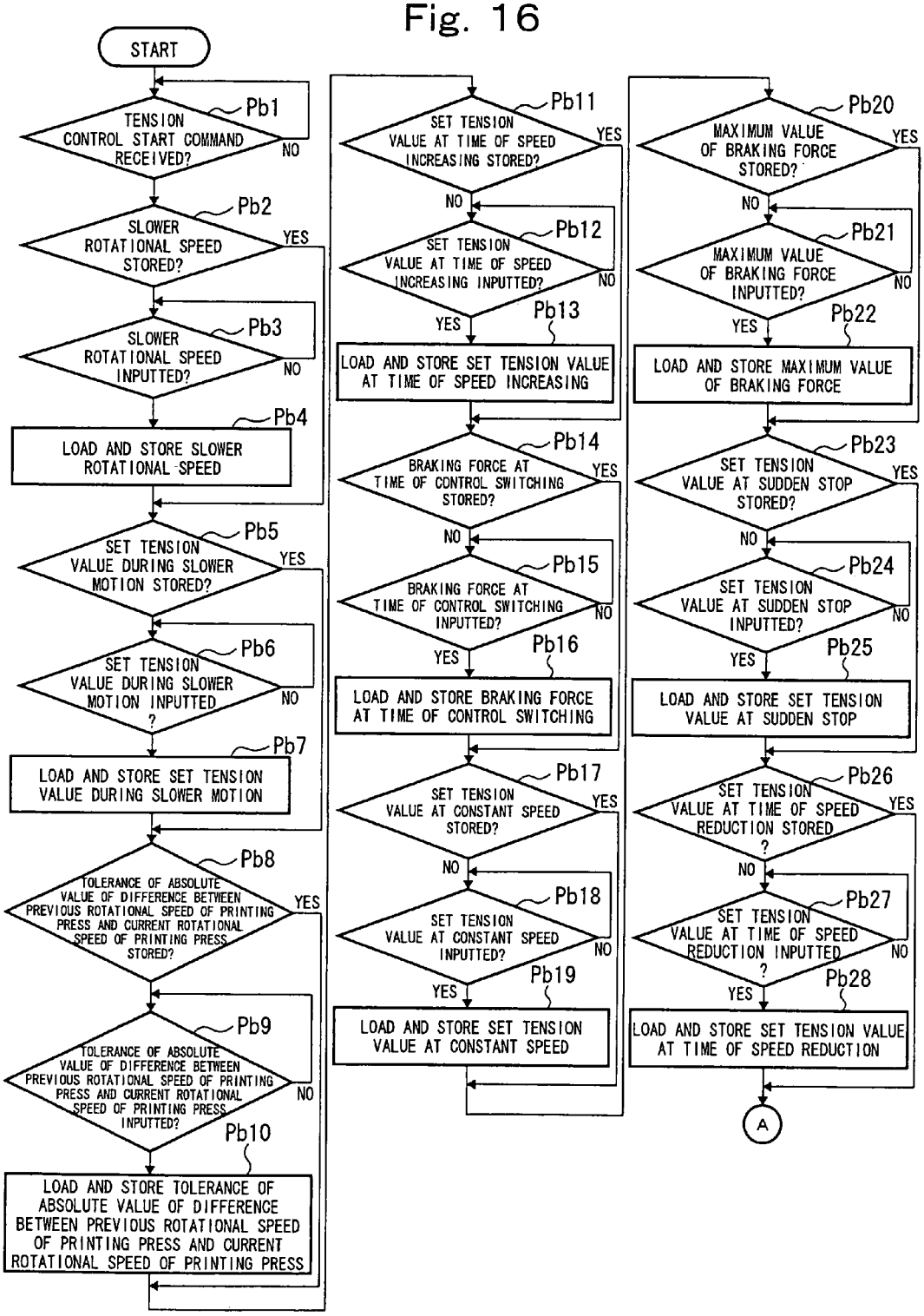
FIG. 16 is an action flow chart for the tension control device showing Embodiment 2 of the present invention.
Figure 17:
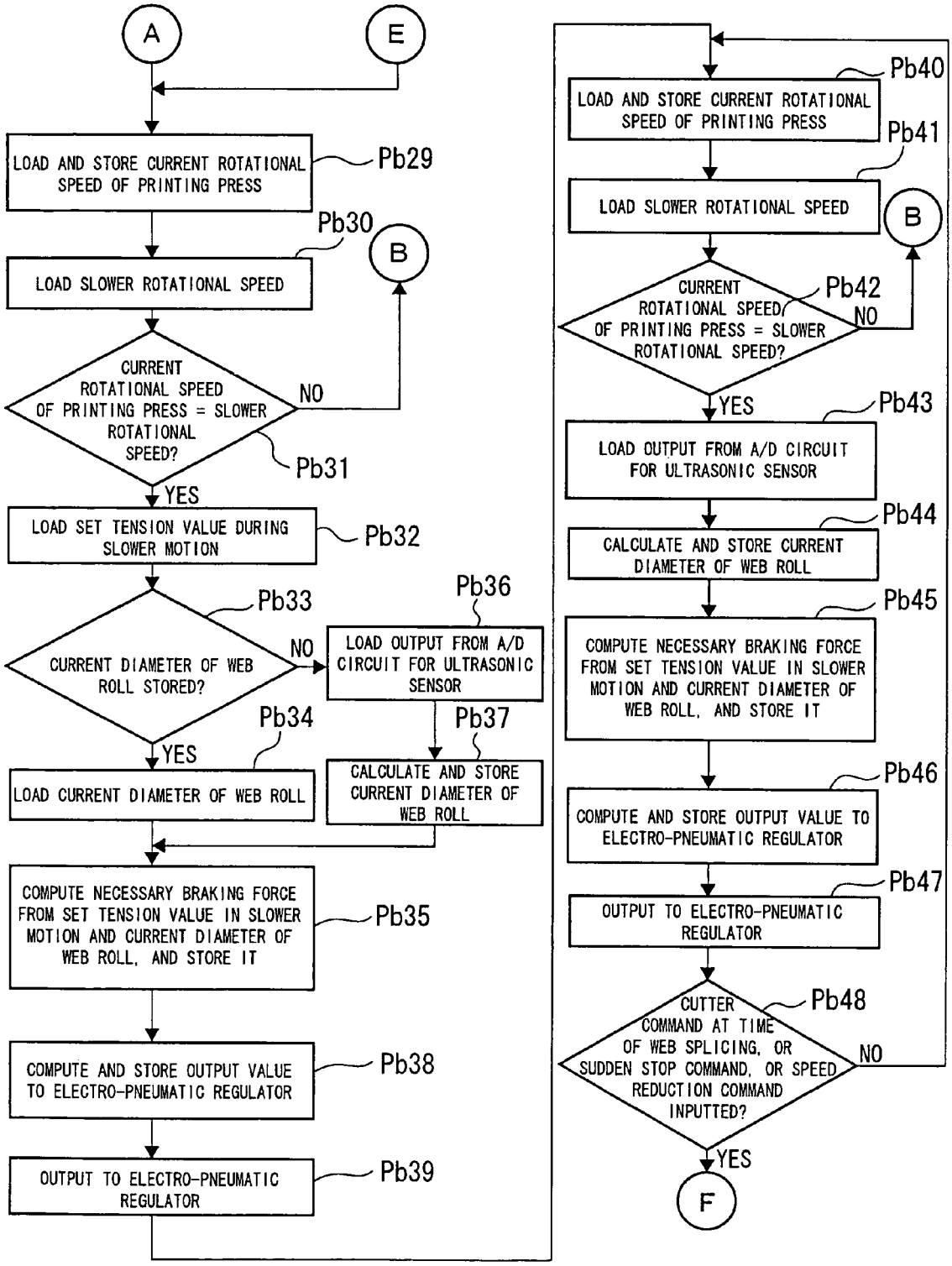
FIG. 17 is an action flow chart for the tension control device.
Figure 18:
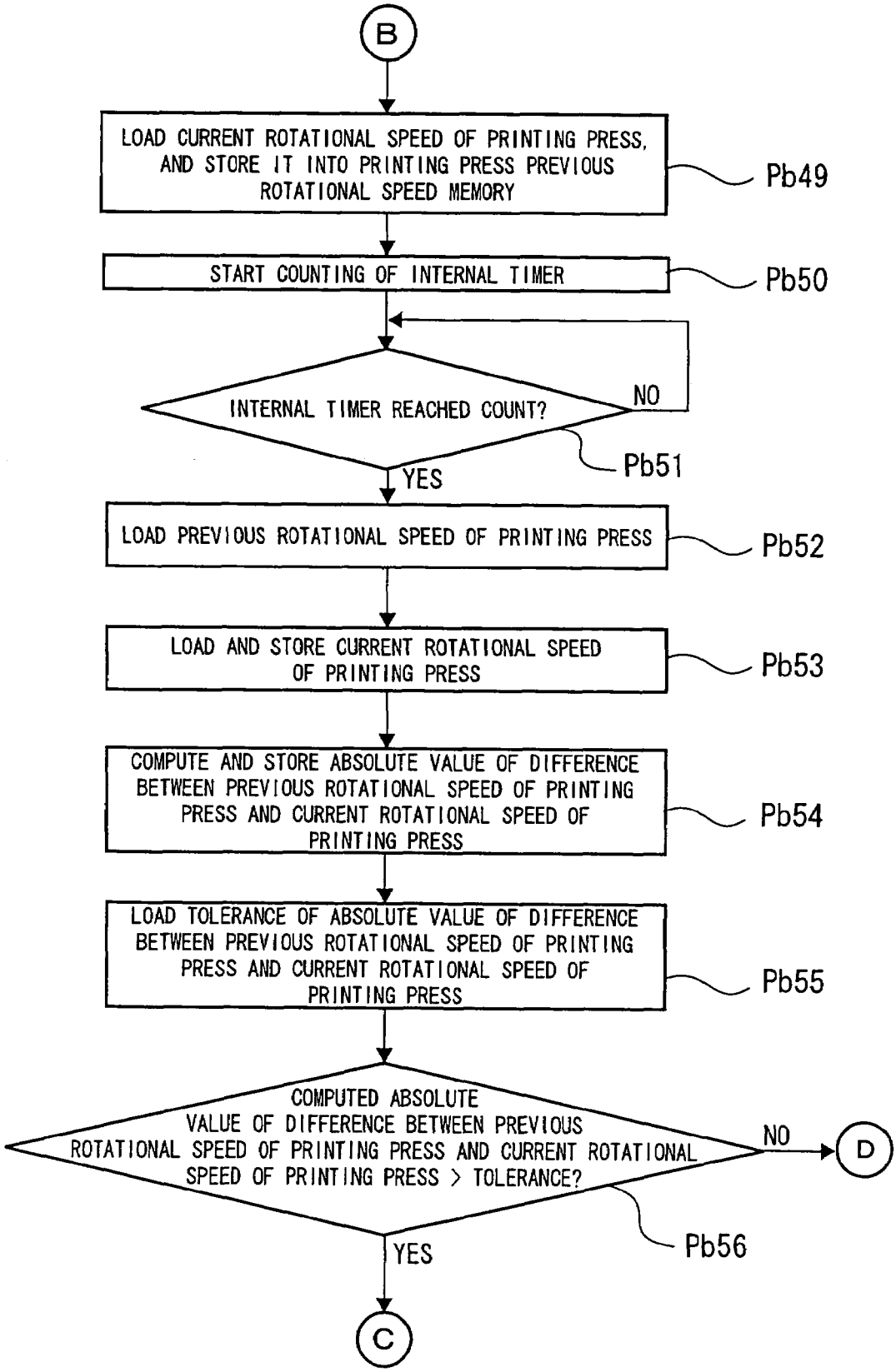
FIG. 18 is an action flow chart for the tension control device.
Figure 19:
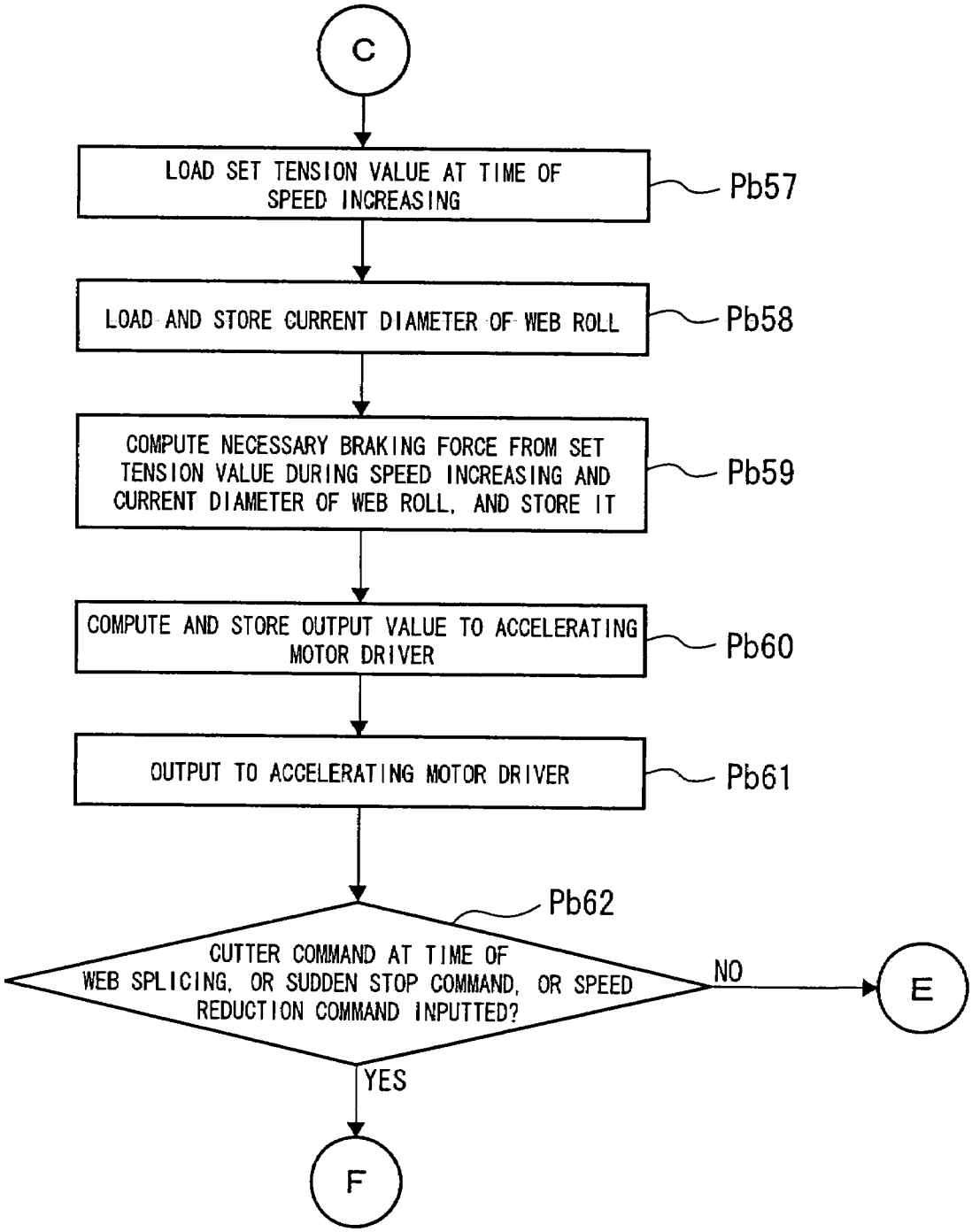
FIG. 19 is an action flow chart for the tension control device.
Figure 20:
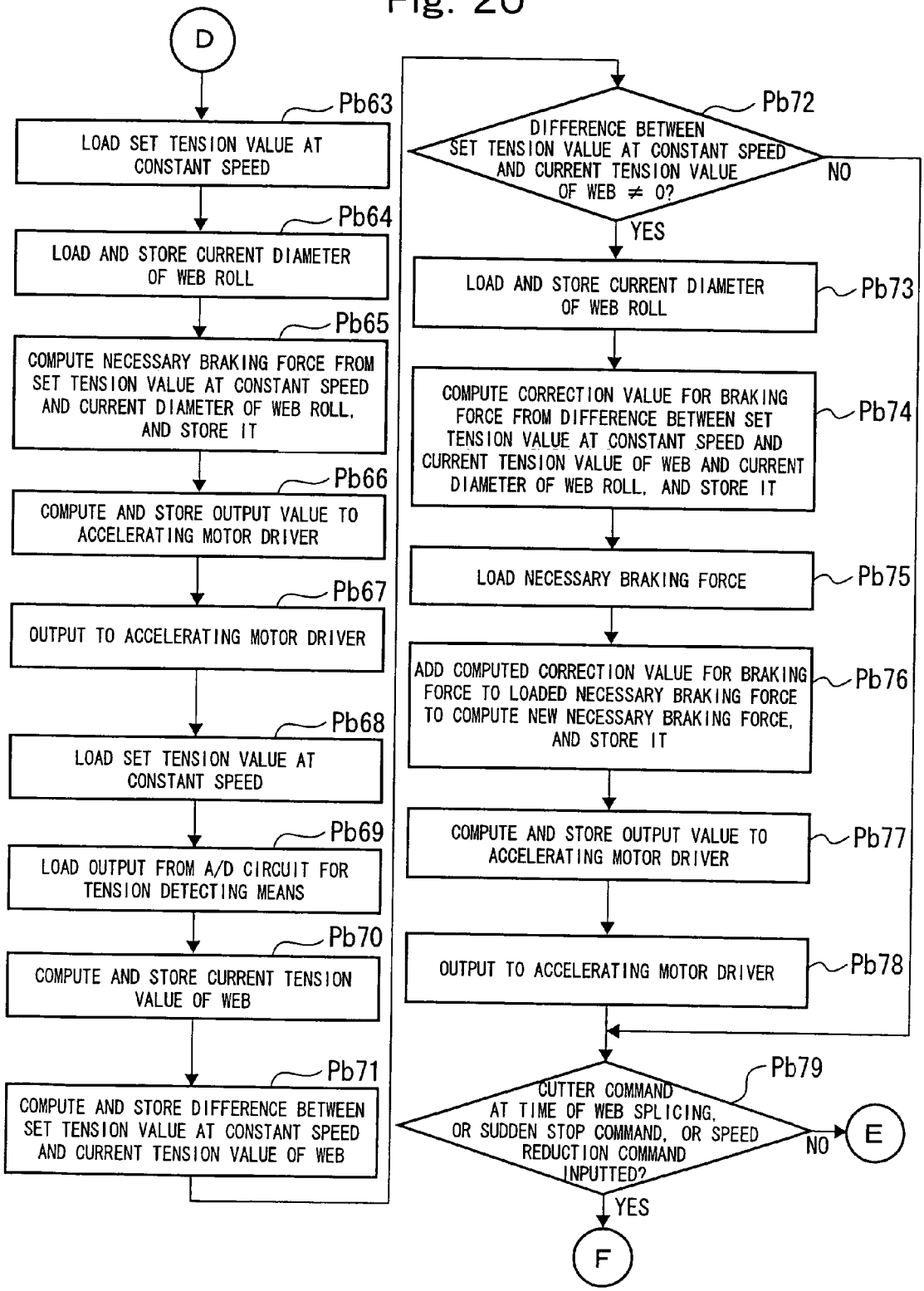
FIG. 20 is an action flow chart for the tension control device.
Figure 21:
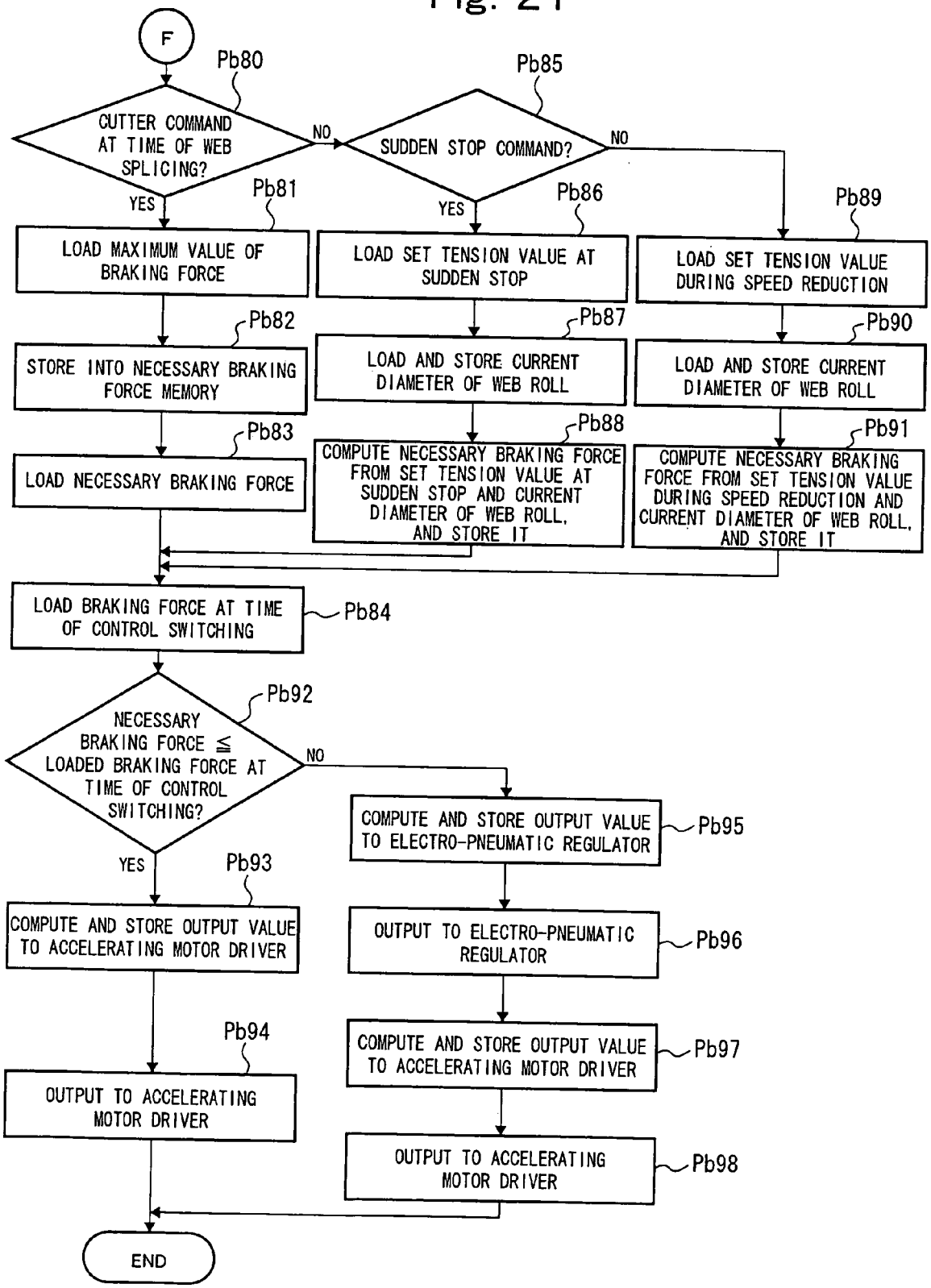
FIG. 21 is an action flow chart for the tension control device.
Figure 22:
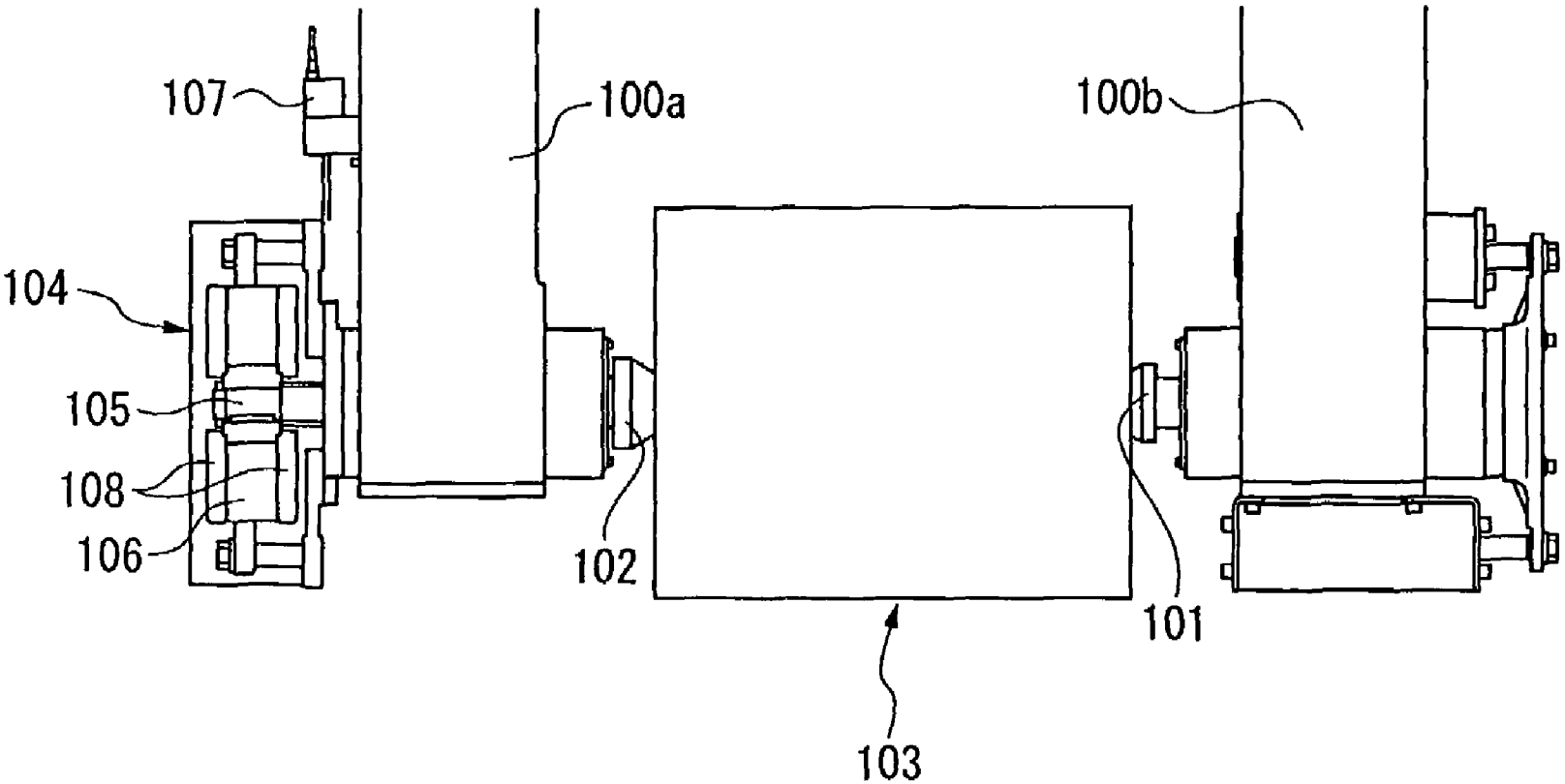
FIG. 22 is a sectional view of essential parts of a conventional feeding device.
Figure 23:
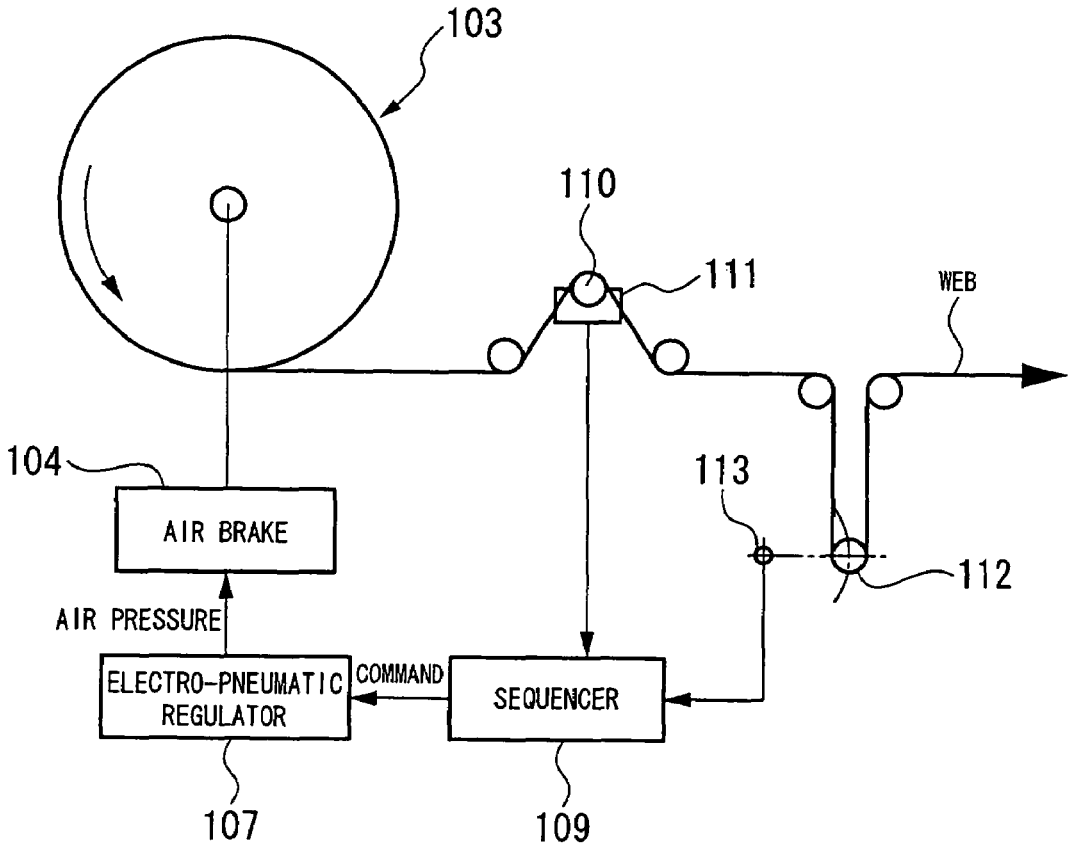
FIG. 23 is a schematic constitutional drawing of a conventional braking force control device.

FIG. 1 is a schematic view of an offset rotary press showing Embodiment 1 of the present invention. FIG. 2 is a sectional view of essential parts of a feeding device. FIG. 3 is a schematic constitutional drawing of a braking force control device. FIGS. 4(*a*) to 4(*c*) are comparative explanation drawings of the control output-torque characteristics of the present invention versus earlier technologies. FIG. 5 is a block diagram of a tension control device. FIG. 6 is a detail drawing of essential parts of FIG. 5. FIG. 7 is a block diagram of a control device of the printing press. FIGS. 8 to 13 are action flow charts for the tension control device. FIG. 14 is an action flow chart for the control device of the printing press. FIG. 15 is an action flow chart for a remaining paper length meter.

In an offset rotary press, as shown in FIG. 1, an unwound strip of paper (web) W, as a strip-shaped material, is continuously supplied from a feeding device 1 as a strip-shaped material (continuous) feeding device. When passing through each printing unit 2, the web W undergoes various types of printing. Then, when passing through a dryer 3, the web W is heated and dried. Subsequently, the web W is cooled during passage through a cooling device 4. Then, when the web W passes through a web path device 5 and a drag device 6, its tension is controlled or its direction is changed. Then, the web W is cut and folded to a predetermined shape by a folding machine 7.

In the feeding device 1, as shown in FIG. 2, a web roll 13 is rotatably supported between a pair of turret arms 10*a* and 10*b*, which constitute web roll support means, via mechanical chucks 11*a*, 11*b* and spindle shafts (rotating shafts) 12*a*, 12*b*. The web roll 13 is braked by an air brake 14A as brake means and an accelerating motor 15A as drive means when tension is controlled in a routine operation or when the printing press is suddenly stopped.

The air brake 14A is of an ordinary type pressing brake pads 17, which are supplied with pressurized air controlled by an electro-pneumatic regulator 18A, against the side surface of a brake disk 16 secured onto the spindle shaft 12*a*, thereby applying a braking force in a rotating direction to the spindle shaft 12*a* (web roll 13). Assume that the air brake 14A and the electro-pneumatic regulator 18A illustrated here are a mechanism provided on an A axis. In this case, an air brake 14B and an electro-pneumatic regulator 18B are provided on a B axis for the web roll (not shown) rotatably supported by a similar structure at another end portion of the turret arms 10*a*, 10*b*.

The motor 15A is of an ordinary type which constitutes an accelerating device having a timing belt 20 looped between a small diameter pulley 19*a* fixed onto an output shaft of the motor 15A and a large diameter pulley 19*b* fixed onto the spindle shaft 12*b*. Similarly to the air brake 14A or 14B, if the illustrated motor 15A is provided on the A axis, an accelerating motor 15B is provided on the B axis for another web roll (not shown). At the time of web splicing to be described later, a new web roll 13 on the B axis, for example, is rotated at the same speed as the speed of an old web roll 13 on the A axis. For this purpose, a drive force in the rotating direction is given to the spindle shaft 12*b* for the new web roll 13. At the time of speed reduction to be described later, on the other hand, a braking force in the rotating direction (a regenerative braking force) is given to the spindle shaft 12*b* for the old web roll 13.

As shown in FIG. 3, for tension control (braking force control) during a routine operation (hereinafter referred to as "at a constant speed"), for example, a control torque command according to the diameter of the web roll 13, which has been computed, is outputted by a tension control device 21 to the accelerating motor 15A (15B) via an accelerating motor driver 22A (22B) to impart tension to the unwound web W. Based on a value detected by a tension sensor 25*a* (detects the tight side of tension) in a tension roller 24 and a position detected by a potentiometer 25*b* (detects the loose side of tension) in a dancer roller 26, feedback control is exercised.

As shown in FIG. 4(*a*), if a torque more than a torque producible by the motor 15A (15B) (for the producible torque, see a motor regenerative brake torque amount in the drawing) is required, a torque control command corresponding to a shortfall is outputted, as an air pressure (see an air brake torque amount in the drawing), to the air brake 14A (14B) via the electro-pneumatic regulator 18A (18B).

Figure 8:
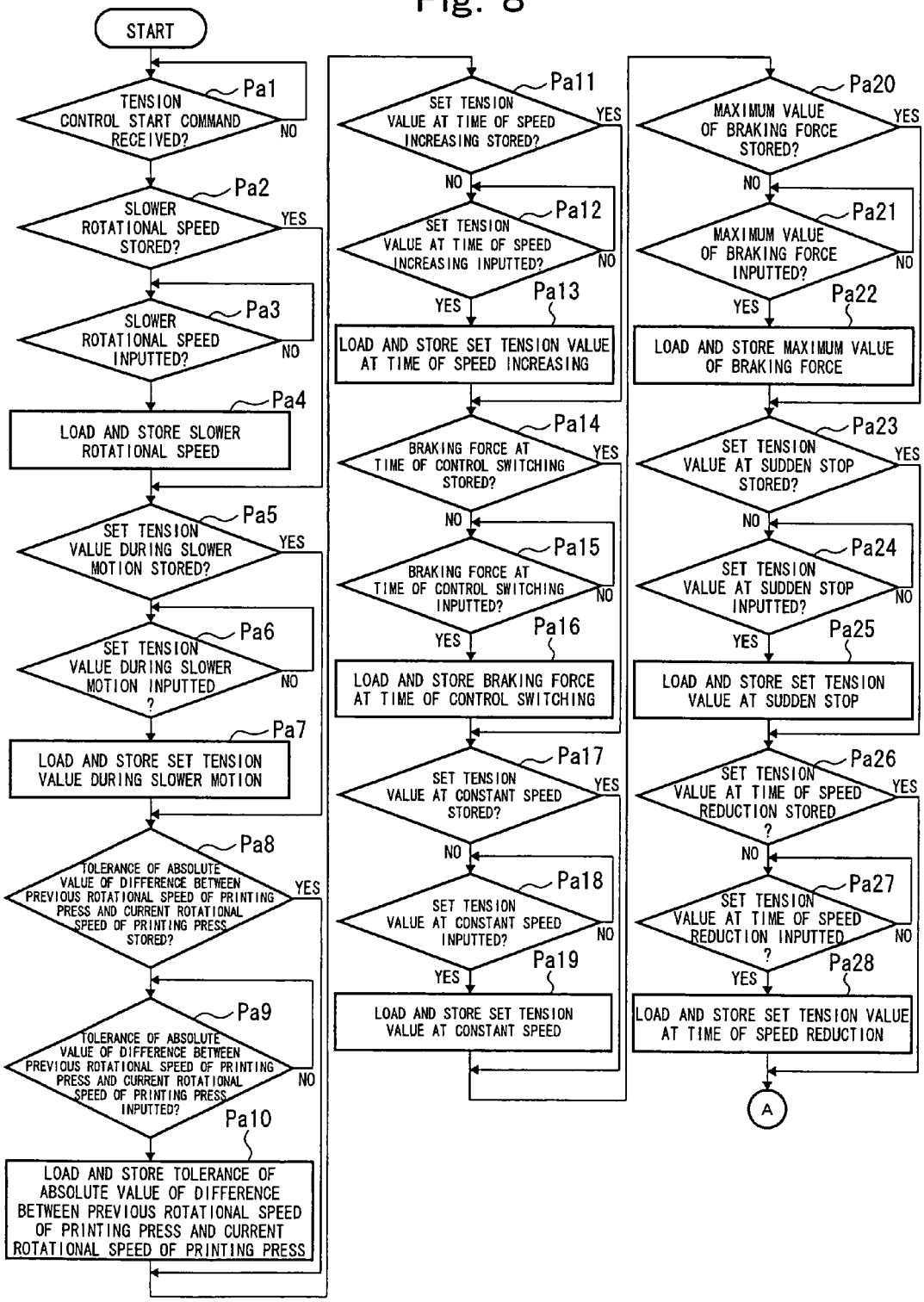
FIG. 8 is an action flow chart for the tension control device.
Figure 9:
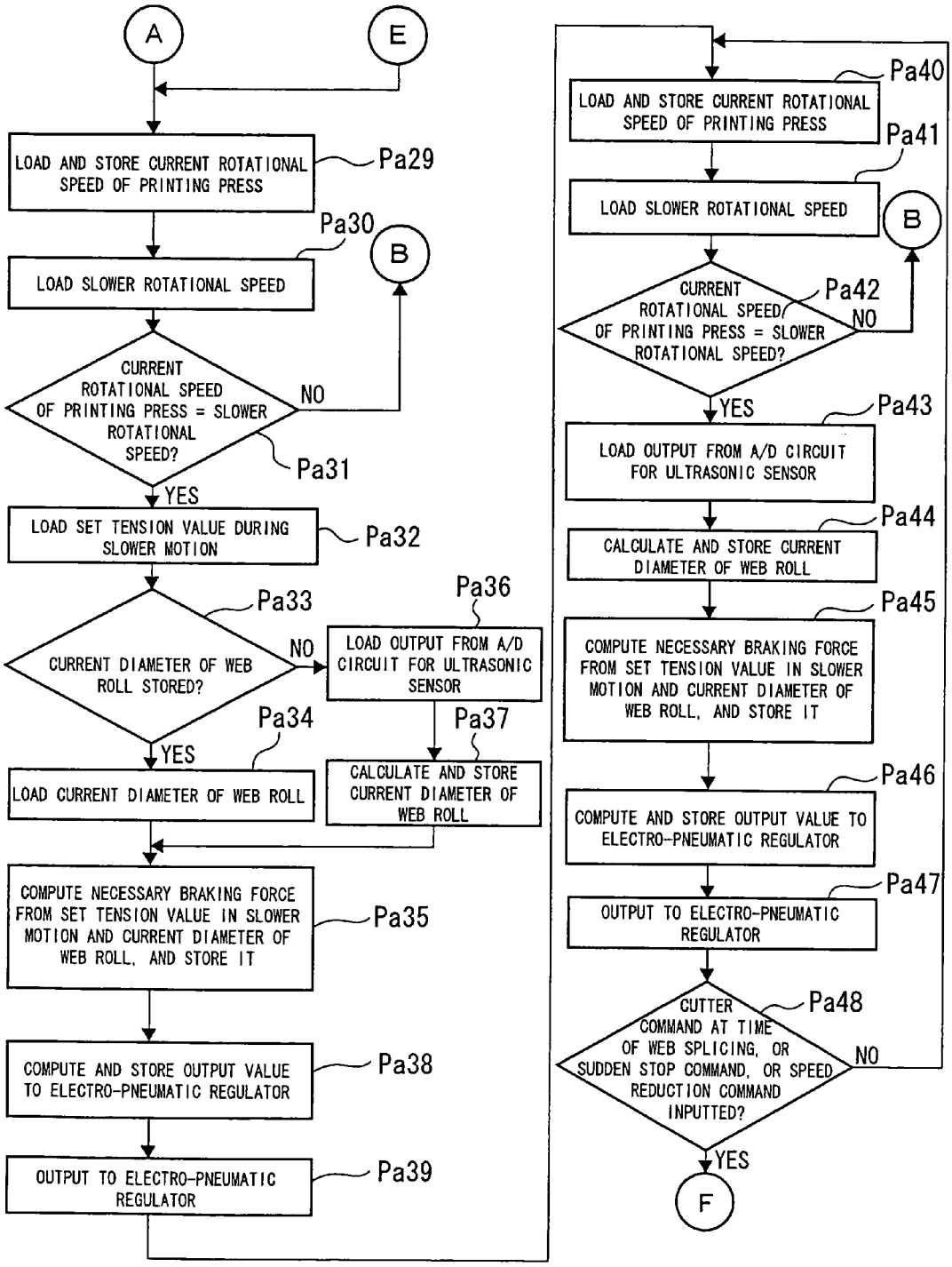
FIG. 9 is an action flow chart for the tension control device.
Figure 10:
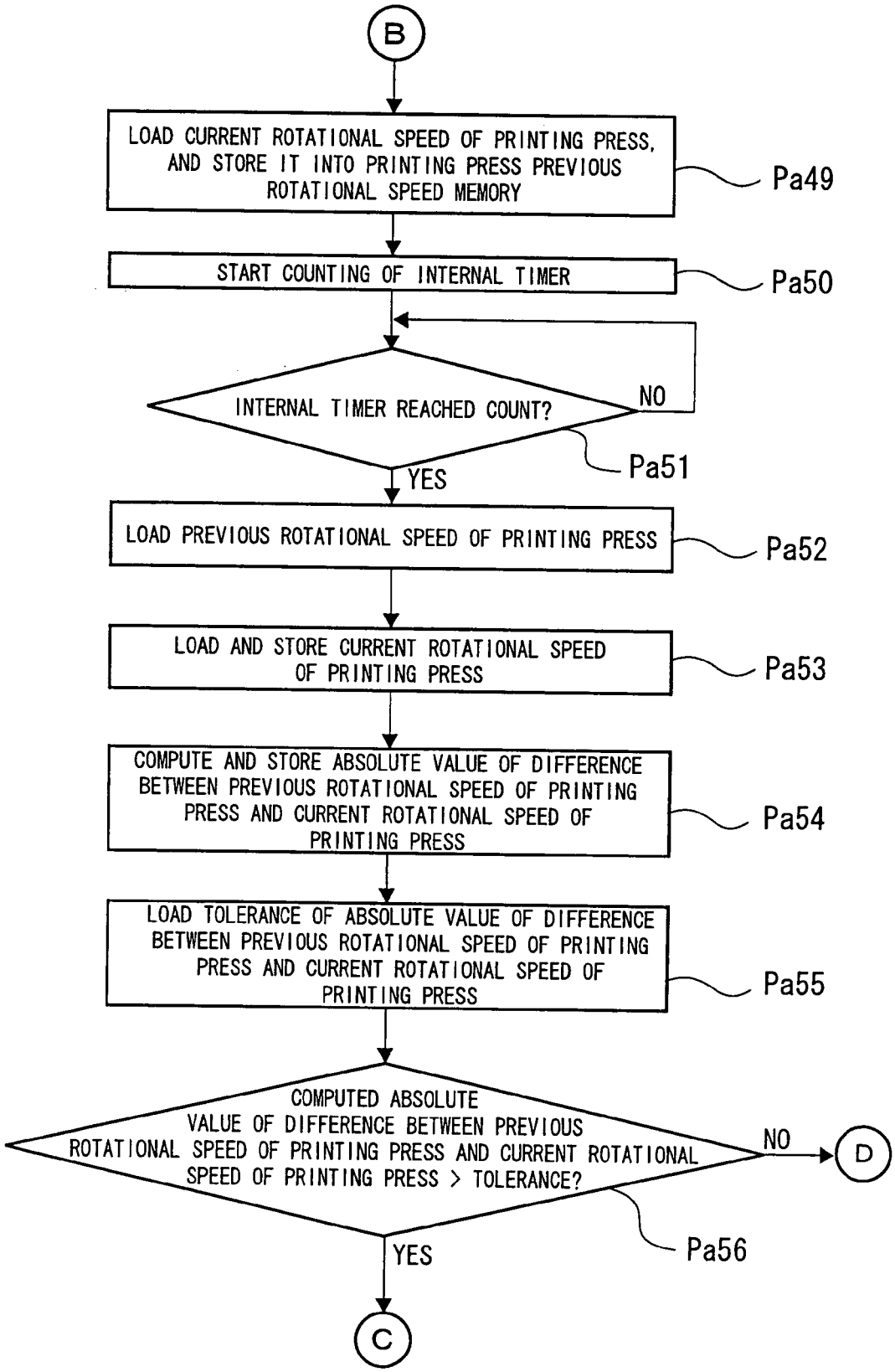
FIG. 10 is an action flow chart for the tension control device.
Figure 11:
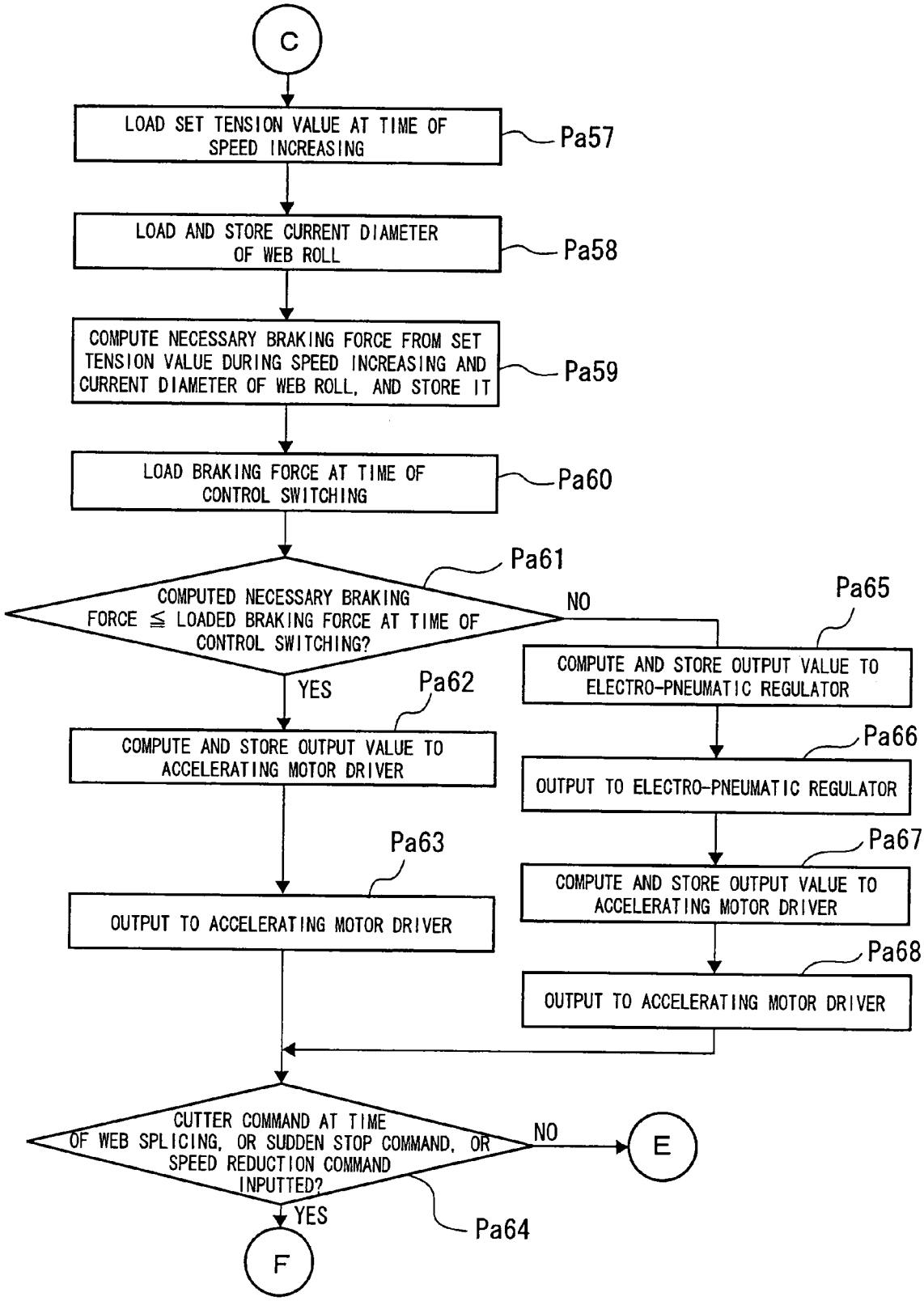
FIG. 11 is an action flow chart for the tension control device.
Figure 12:
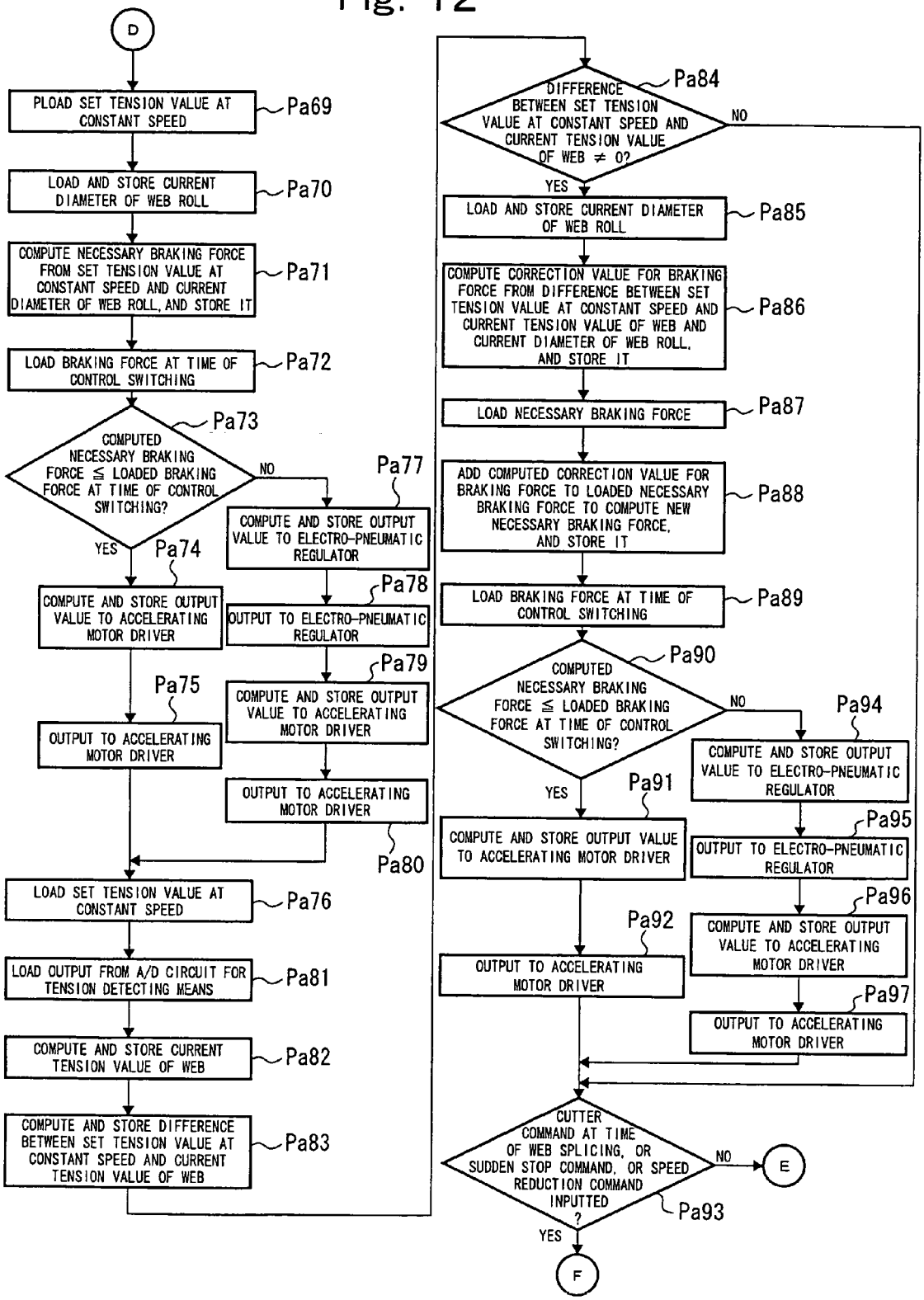
FIG. 12 is an action flow chart for the tension control device.
Figure 13:
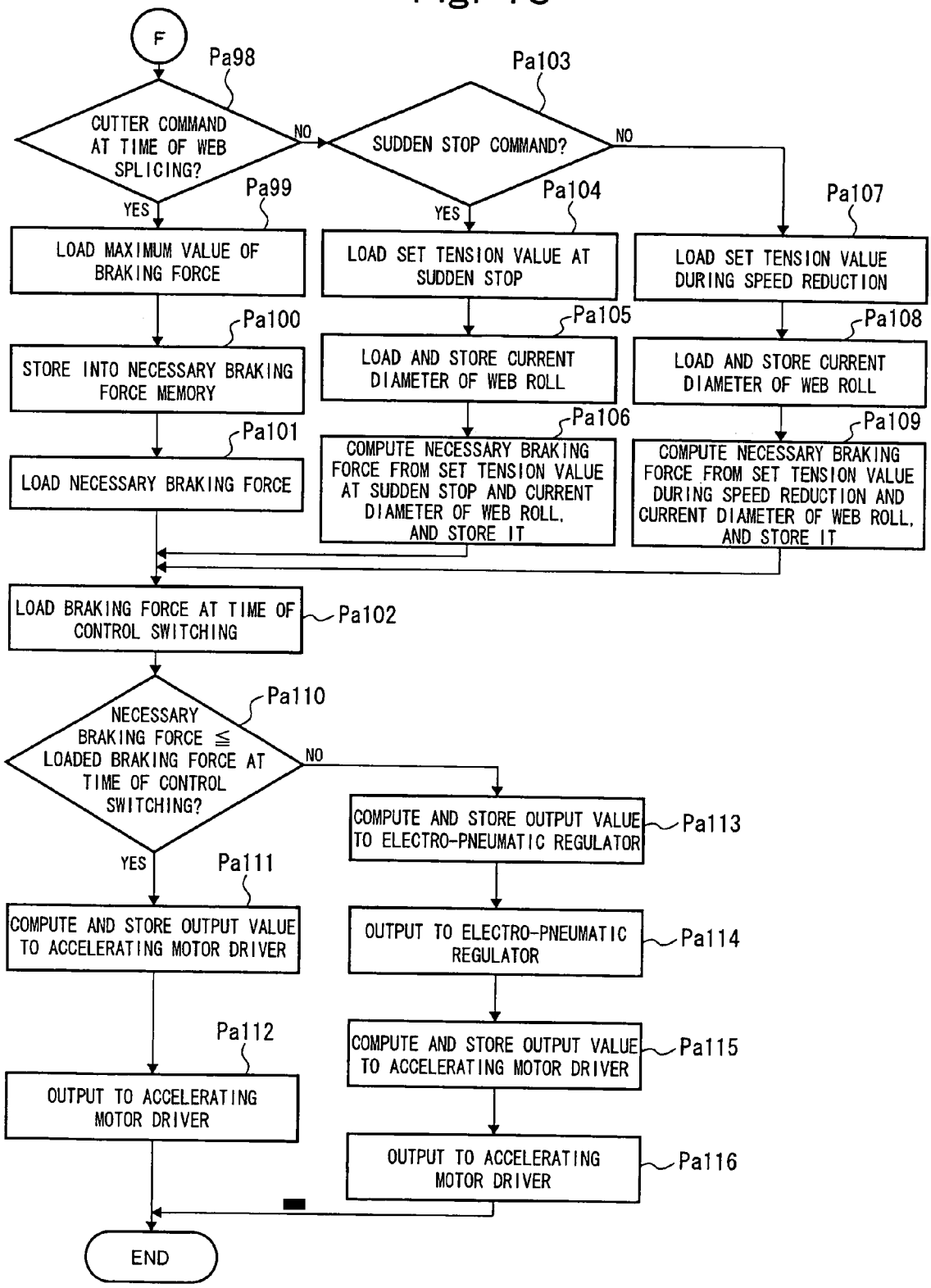
FIG. 13 is an action flow chart for the tension control device.

In describing the tension control device 21 in detail, the control device of the printing press will be described with reference to FIGS. 7 and 8.

As shown in FIG. 7, a control device 30 of the printing press comprises CPU31, RAM32, ROM33, a current rotational speed memory 34 for the printing press, and a voltage printing press rotational speed conversion curve memory 35 connected to input-output devices 36*a*, 36*b* and an interface 37 by a bus line (BUS) 38.

A drive motor 39 of the printing press is connected to the input-output device 36a via a drive motor driver 40, and a drive motor rotary encoder 41 is also connected to the input-output device 36a via an AID converter 42 and an F/V converter 43. An input device 44, such as a keyboard, various switches and buttons, a display device 45 such as CRT and lamp, and an output device 46 such as a printer and a ED drive are connected to the input-output device 36b. A tension control device 21 to be described later is connected to the interface 37.

The so constituted control device 30 of the printing press acts according to an action flow shown in FIG. 14. In Step P1, an output voltage from the F/V converter 43 is read. Then, in Step P2, the current rotational speed of the printing press is found from the output voltage from the F/V converter 43 with the use of a rotational speed conversion curve stored in the voltage printing press rotational speed conversion curve memory 35.

Then, in Step P3, it is determined whether the current rotational speed of the printing press is greater than 0 (zero). If it is greater than zero, a tension control start signal is communicated to the tension control device 21 in Step P4. Then, in Step P5, it is determined whether an inquiry is made by the tension control device 21 as to the current rotational speed of the printing press.

If there is the inquiry in Step P5, the output voltage from the F/V converter 43 is read in Step P6. Then, in Step P7, the current rotational speed of the printing press is found from the output voltage from the F/V converter 43 with the use of the rotational speed conversion curve stored in the voltage printing press rotational speed conversion curve memory 35. Then, in Step P8, the current rotational speed of the printing press is communicated to the tension control device 21. Then, the program returns to Step P5.

If there is no inquiry about the rotational speed in Step P5, it is determined in Step P9 whether a cutter output for web splicing is rendered ON in order to carry out splicing of the web W between the new and old web rolls 13 in the feeding device 1. If ON, a cutter command for web splicing is communicated to the tension control device 21 in Step P10. Then, the program returns to Step P5. If not ON in Step P9, it is determined in Step P11 whether a sudden stop switch is ON in order to stop the printing press suddenly. If ON, a sudden stop command is communicated to the tension control device 21 in Step P12. Then, the program returns to Step PS. If not ON in Step P11, it is determined in Step P13 whether a speed reduction switch is ON in order to reduce the speed of the printing press. If ON, a speed reduction command is communicated to the tension control device 21 in Step P14. Then, the program returns to Step P5.

As described above, the control device 30 of the printing press outputs to the tension control device 21 operational information as to whether the printing press is under tension control at a constant speed, or which of web splicing, sudden stop, and speed reduction the printing press is subjected to. The control device 30 also outputs the current rotational speed of the printing press to the tension control device 21 in response to the inquiry from the tension control device 21.

The tension control device 21, as shown in FIG. 5, comprises the CPU 31, RAM 32, ROM 33, and a memory group 50 (to be described later) connected to input-output devices 36*b* to 36*i* and interfaces 47*a*, 48*a* by the bus line (BUS) 38.

The aforementioned control device 30 of the printing press is connected to the interface 47*a* via an interface 47*b*. A remaining paper length meter 81 is connected to the interface 48*a* via an interface 48*b*. The remaining paper length meter 81 is a computational device which always monitors the remaining paper length of the old web roll 13; calculates how many minutes remain until web splicing is needed if the web is rolled off at the current web travel speed; and outputs a web splicing make ready start signal to the control device 30 of the printing press when the remaining time is the make ready time or less. The concrete features of the remaining paper length meter 81 are already rendered publicly known by Japanese Utility Model Registration No. 2568743, and its detailed explanation is omitted herein. In the present embodiment, as shown in an action flow chart of FIG. 15, when an inquiry about the current diameter of the web roll 13 is made by the tension control device 21, the current diameter of the web roll 13 is outputted to the tension control device 21.

A web diameter measurement distance measuring instrument 83 is connected to the input-output device 36*c* via an A/D converter 82. The web diameter measurement distance measuring instrument 83 is an instrument which, when the new web roll 13 stops at a diameter measuring position, is located at a position opposed to the circumferential surface of the new web roll 13 for measuring the distance to the circumferential surface of the new web roll 13 by use of an ultrasonic sensor or the like. In detail, the turret arms 10*a*, 10*b*, which are rotating, are stopped at the diameter measuring position of the new web roll 13. In this state, the distance (L1) to the circumferential surface of the new web roll 13 is measured by the web diameter measurement distance measuring instrument 83. Based on the measured value, the diameter (d1) of the new web roll 13 is determined. That is, the distance (L2) between the web diameter measurement distance measuring instrument 83 and the center of the new web roll 13 is known. Thus, a calculation is made for $d1=2\times(L2-L1)$, whereby the diameter (d1) of the new web roll 13 can be determined.

Tension detecting means 25 composed of the aforementioned tension sensor 25*a* and potentiometer 25*b* is connected to the input-output device 36*d* via an A/D converter 84. A setting instrument group 70 to be described later is connected to the input-output device 36*e*.

The air brake 14A on the A axis is connected to the input-output device 36*f* via the aforementioned electro-pneumatic regulator 18A on the A axis. The accelerating motor 15A on the A axis is connected, along with an accelerating motor rotary encoder 23A on the A axis, to the input-output device 36*g* via the aforementioned accelerating motor driver 22A on the A axis.

The air brake 14B on the B axis is connected to the input-output device 36*h* via the aforementioned electro-pneumatic regulator 18B on the B axis. The accelerating motor 15B on the B axis is connected, along with an accelerating motor rotary encoder 23B on the B axis, to the input-output device 36*i* via the aforementioned accelerating motor driver 22B on the B axis.

As shown in FIG. 6, the aforementioned memory group 50 has a printing press current rotational speed memory 34, a slower rotational speed memory 51, a slower motion set tension value memory 52, a web roll current diameter memory 53, a printing press previous rotational speed memory 54, a printing press previous rotational speed printing press current rotational speed difference absolute value memory 55, a printing press previous rotational speed printing press current rotational speed difference absolute value tolerance memory 56, a speed increasing set tension value memory 57, a control switching braking force memory 58, a constant speed set tension value memory 59, a web current tension value memory 60, a constant speed set tension value web current tension value difference memory 61, a braking force correction value memory 62, a braking force maximum value memory 63, a sudden stop set tension value memory 64, a speed reduction set tension value memory 65, a necessary braking force memory 66, an output value to electro-pneumatic regulator memory 67, and an output value to accelerating motor driver memory 68.

The aforementioned setting instrument group 70 comprises a slower rotational speed setting instrument 71, a slower motion set tension value setting instrument (reference tension setting means) 72, a printing press previous rotational speed printing press current rotational speed difference absolute value tolerance setting instrument 73, a speed increasing set tension value setting instrument (reference tension setting means) 74, a motor regenerative brake torque control ⇔(motor regenerative brake torque control+air brake torque control) control switching braking force setting instrument 75, a constant speed set tension value setting instrument (reference tension setting means) 76, a braking force maximum value setting instrument 77, a sudden stop set tension value setting instrument (reference tension setting means) 78, and a speed reduction set tension value setting instrument (reference tension setting means) 79. Other features are the same as those in the control device 30 of the printing press. Thus, the same members as those shown in FIG. 7 are assigned the same numerals and symbols as those in FIG.7, and duplicate explanations are omitted.

The so configured tension control device 21 acts according to action flows shown in FIGS. 8 to 13.

When a tension control start command is received from the control device 30 of the printing press in Step Pa1, it is determined in Step Pa2 whether a slower rotational speed is stored in the slower rotational speed memory 51. If the slower rotational speed is stored, it is determined in Step Pa5 whether a set tension value during a slower motion is stored in the slower motion set tension value memory 52. If the slower rotational speed is not stored in Step Pa2, the slower rotational speed is inputted into the slower rotational speed setting instrument 71 in Step Pa3. Then, in Step Pa4, the slower rotational speed is loaded from the slower rotational speed setting instrument 71, and stored. Then, the program proceeds to Step Pa5.

Then, if the set tension value in a slower motion is stored in Step Pa5, it is determined in Step Pa8 whether the tolerance of the absolute value of the difference between the previous rotational speed of the printing press and the current rotational speed of the printing press is stored in the printing press previous rotational speed printing press current rotational speed difference absolute value tolerance memory 56. If the set tension value in a slower motion is not stored in Step Pa5, the set tension value in a slower motion is entered into the slower motion set tension value setting instrument 72 in Step Pa6. Then, in Step Pa7, the set tension value in a slower motion is loaded from the slower motion set tension value setting instrument 72, and stored. Then, the program proceeds to Step Pa8.

If the tolerance of the absolute value of the difference between the previous rotational speed of the printing press and the current rotational speed of the printing press is stored in Step Pa8, it is determined in Step Pa11 whether a set tension value at the time of speed increasing is stored in the speed increasing set tension value memory 57. If the tolerance of the absolute value of the difference between the previous rotational speed of the printing press and the current rotational speed of the printing press is not stored in Step Pa8, the tolerance of the absolute value of the difference between the previous rotational speed of the printing press and the current rotational speed of the printing press is entered into the printing press previous rotational speed printing press current rotational speed difference absolute value tolerance setting instrument 73 in Step Pa9. Then, in Step Pa10, the tolerance of the absolute value of the difference between the previous rotational speed of the printing press and the current rotational speed of the printing press is loaded, for storage, from the printing press previous rotational speed printing press current rotational speed difference absolute value tolerance setting instrument 73. Then, the program proceeds to Step Pa11.

Then, if the set tension value at the time of speed increasing is stored in Step Pa11, it is determined in Step Pa14 whether a braking force at the time of control switching is stored in the control switching braking force memory 58. If the set tension value at the time of speed increasing is not stored in Step Pa11, a set tension value during speed increasing is entered into the speed increasing set tension value setting instrument 74 in Step Pa12. Then, in Step Pa13, the set tension value during speed increasing is loaded from the speed increasing set tension value setting instrument 74, and stored, where after the program proceeds to Step Pa14.

If the braking force at the time of control switching is stored in Step Pa14, it is determined in Step Pa17 whether a set tension value at a constant speed is stored in the constant speed set tension value memory 59. If the braking force at the time of control switching is not stored in Step Pa14, the braking force at the time of control switching is entered into the control switching braking force setting instrument 75 in Step Pa15. Then, in Step Pa16, the braking force at the time of control switching is loaded from the control switching braking force setting instrument 75, and stored. Then, the program proceeds to Step Pa17.

If the set tension value at a constant speed is stored in Step Pa17, it is determined in Step Pa20 whether a maximum value of a braking force is stored in the braking force maximum value memory 63. If the set tension value at a constant speed is not stored in Step Pa17, the set tension value at a constant speed is entered into the constant speed set tension value setting instrument 76 in Step Pa18. Then, in Step Pa19, the set tension value at a constant speed is loaded from the constant speed set tension value setting instrument 76, and stored. Then, the program proceeds to Step Pa20.

If the maximum value of a braking force is stored in Step Pa20, it is determined in Step Pa23 whether a set tension value at a sudden stop is stored in the sudden stop set tension value memory 64. If the maximum value of a braking force is not stored in Step Pa20, the maximum value of a braking force is entered into the braking force maximum value setting instrument 77 in Step Pa21. Then, in Step Pa22, the maximum value of a braking force is loaded from the braking force maximum value setting instrument 77 and stored. Then, the program proceeds to Step Pa23.

If the set tension value at a sudden stop is stored in Step Pa23, it is determined in Step Pa26 whether a set tension value at the time of speed reduction is stored in the speed reduction set tension value memory 65. If the set tension value at a sudden stop is not stored in Step Pa23, the set tension value at a sudden stop is entered into the sudden stop set tension value setting instrument 78 in Step Pa24. Then, in Step Pa25, the set tension value at a sudden stop is loaded from the sudden stop set tension value setting instrument 78 and stored. Then, the program proceeds to Step Pa26.

If the set tension value at the time of speed reduction is stored in Step Pa26, the current rotational speed of the printing press is loaded from the control device 30 of the printing press and stored in Step Pa29. If the set tension value at the time of speed reduction is not stored in Step Pa26, the set tension value during speed reduction is entered into the speed reduction set tension value setting instrument 79 in Step Pa27. Then, in Step Pa28, the set tension value during speed reduction is loaded from the speed reduction set tension value setting instrument 79 and stored. Then, the program proceeds to Step Pa29.

Then, in Step Pa30, the slower rotational speed is loaded, where after it is determined in Step Pa31 whether the current rotational speed of the printing press agrees with the slower rotational speed. If there is this agreement, the set tension value during a slower motion is loaded from the slower motion set tension value memory 52 in Step Pa32. If there is no such agreement, the program proceeds to Step Pa49 to be described later.

Then, in Step Pa33, it is determined whether the current diameter of the web roll 13 is stored in the web roll current diameter memory 53. If the current diameter of the web roll 13 is stored, the current diameter of the web roll 13 is loaded from the web roll current diameter memory 53 in Step Pa34. Then, in Step Pa35, a necessary braking force is computed from the set tension value in a slower motion and the current diameter of the web roll 13, and the necessary braking force is stored.

If the current diameter of the web roll 13 is not stored in Step Pa33, the output from the A/D converter 82 for the ultrasonic sensor of the web diameter measurement distance measuring instrument 83 is loaded in Step Pa36. Then, in Step Pa37, the current diameter of the web roll 13 is calculated from the output from the A/D converter 82 for the ultrasonic sensor, and stored. Then, the program proceeds to Step Pa35.

Then, in Step Pa38, an output value to the electro-pneumatic regulator 18A is computed from the computed necessary braking force, and stored. Then, in Step Pa39, the computed output value to the electro-pneumatic regulator 18A is outputted to the electro-pneumatic regulator 18A.

Then, in Step Pa40, the current rotational speed of the printing press is loaded from the control device 30 of the printing press and stored. In Step Pa41, the slower rotational speed is loaded. Then, in Step Pa42, it is determined whether the current rotational speed of the printing press agrees with the slower rotational speed. If there is this agreement, the output from the A/D converter 82 for the ultrasonic sensor of the web diameter measurement distance measuring instrument 83 is loaded in Step Pa43. If there is no such agreement, the program proceeds to Step Pa49 to be described later.

Then, in Step Pa44, the current diameter of the web roll 13 is calculated from the output from the A/D converter 82 for the ultrasonic sensor, and stored. Then, in Step Pa45, a necessary braking force is computed from the set tension value in a slower motion and the current diameter of the web roll 13, and the necessary braking force is stored.

Then, in Step Pa46, an output value to the electro-pneumatic regulator 18A is computed from the computed necessary braking force, and stored. Then, in Step Pa47, the computed output value to the electro-pneumatic regulator 18A is outputted to the electro-pneumatic regulator 18A.

Then, in Step Pa48, it is determined whether a cutter command at the time of web splicing, or a sudden stop command, or a speed reduction command has been inputted from the control device 30 of the printing press. If any of the commands has been inputted, the program proceeds to Step Pa98 to be described later. If no such command has been inputted, the program returns to Step Pa40.

If the current rotational speed of the printing press and the slower rotational speed do not agree in Step Pa31 or Step Pa42, the program proceeds to Step Pa49 to load the current rotational speed of the printing press from the printing press current rotational speed memory 34, and store the current rotational speed into the printing press previous rotational speed memory 54.

Then, in Step Pa50, counting of an internal timer is started. If the internal timer reaches the count in Step Pa51, the previous rotational speed of the printing press is loaded from the printing press previous rotational speed memory 54 in Step Pa52.

Then, in Step Pa53, the current rotational speed of the printing press is loaded from the control device 30 of the printing press, and stored. Then, in Step Pa54, the absolute value of the difference between the previous rotational speed of the printing press and the current rotational speed of the printing press is computed and stored.

Then, in Step Pa55, the tolerance of the absolute value of the difference between the previous rotational speed of the printing press and the current rotational speed of the printing press is loaded from the printing press previous rotational speed printing press current rotational speed difference absolute value tolerance memory 56. Then, in Step Pa56, it is determined whether the computed absolute value of the difference between the previous rotational speed of the printing press and the current rotational speed of the printing press is greater than the tolerance of the absolute value of the difference between the previous rotational speed of the printing press and the current rotational speed of the printing press.

If this absolute value is larger than its tolerance in Step Pa56, the set tension value at the time of speed increasing is loaded from the speed increasing set tension value memory 57 in Step Pa57. Then, in Step Pa58, the current diameter of the web roll 13 is loaded from the remaining paper length meter 81 and stored. Then, in Step Pa59, a necessary braking force is computed from the set tension value during speed increasing and the current diameter of the web roll 13, and the necessary braking force is stored. Then, in Step Pa60, the braking force at the time of control switching is loaded from the control switching braking force memory 58.

Then, in Step Pa61, it is determined whether the computed necessary braking force is equal to or lower than the loaded braking force at the time of control switching. If the computed necessary braking force is equal or lower, an output value to the accelerating motor driver 22A is computed from the computed necessary braking force and stored in Step Pa62. Then, in Step Pa63, the computed output value to the accelerating motor driver 22A is outputted to the accelerating motor driver 22A. Then, in Step Pa64, it is determined whether a cutter command at the time of web splicing, or a sudden stop command, or a speed reduction command has been inputted from the control device 30 of the printing press. If any of the commands has been inputted, the program proceeds to Step Pa98 to be described later. If no such command has been inputted, the program returns to Step Pa29.

If the computed necessary braking force is greater than the loaded braking force (constant value) at the time of control switching in Step Pa61, an output value to the electro-pneumatic regulator 18A is computed from the computed necessary braking force and stored in Step Pa65. Then, in Step Pa66, the computed output value to the electro-pneumatic regulator 18A is outputted to the electro-pneumatic regulator 18A. Then, in Step Pa67, an output value to the accelerating motor driver 22A is computed from the computed necessary braking force and stored. Then, in Step Pa68, the computed output value to the accelerating motor driver 22A is outputted to the accelerating motor driver 22A. Then, the program proceeds to Step Pa64. The output value to the electro-pneumatic regulator 18A is such a value that the air brake 14A can supply a braking force by an amount obtained by subtracting the maximum value of the regenerative braking force of the accelerating motor from the necessary braking force, namely, by the difference between the necessary braking force and the maximum value of the regenerative braking force of the accelerating motor 15A. The output value to the accelerating motor driver 22A is such a value that the regenerative braking force of the accelerating motor 15A becomes maximal.

If the absolute value is smaller than the tolerance in Step Pa56, the set tension value at the constant speed is loaded from the constant speed set tension value memory 59 in Step Pa69. Then, in Step Pa70, the current diameter of the web roll 13 is loaded from the remaining paper length meter 81 and stored. Then, in Step Pa71, a necessary braking force is computed from the set tension value at the constant speed and the current diameter of the web roll 13, and stored. Then, in Step Pa72, the braking force at the time of control switching is loaded from the control switching braking force memory 58.

Then, in Step Pa73, it is determined whether the computed necessary braking force is equal to or lower than the loaded braking force at the time of control switching. If the computed necessary braking force is equal or lower, an output value to the accelerating motor driver 22A is computed from the computed necessary braking force and stored in Step Pa74. Then, in Step Pa75, the computed output value to the accelerating motor driver 22A is outputted to the accelerating motor driver 22A. Then, in Step Pa76, the set tension value at the constant speed is loaded from the constant speed set tension value memory 59.

If the computed necessary braking force is greater than the loaded braking force at the time of control switching in Step Pa73, an output value to the electro-pneumatic regulator 18A is computed from the computed necessary braking force and stored in Step Pa77. Then, in Step Pa78, the computed output value to the electro-pneumatic regulator 18A is outputted to the electro-pneumatic regulator 18A. Then, in Step Pa79, an output value to the accelerating motor driver 22A is computed from the computed necessary braking force and stored. Then, in Step Pa80, the computed output value to the accelerating motor driver 22A is outputted to the accelerating motor driver 22A. Then, the program proceeds to Step Pa76. The output value to the electro-pneumatic regulator 18A is such a value that the air brake 14A can supply a braking force by an amount obtained by subtracting the maximum value of the regenerative braking force of the accelerating motor from the necessary braking force, namely, by the difference between the necessary braking force and the maximum value of the regenerative braking force of the accelerating motor 15A. The output value to the accelerating motor driver 22A is such a value that the regenerative braking force of the accelerating motor 15A becomes maximal.

Then, in Step Pa81, an output from the A/D converter 84 for the tension detecting means 25 is loaded. Then, in Step Pa82, the current tension value of the web W is computed from the loaded output from the A/D converter 84 for the tension detecting means 25, and stored. Then, in Step Pa83, the difference between the set tension value at the constant speed and the current tension value of the web W is computed and stored. Then, in Step Pa84, it is determined whether the difference between the set tension value at the constant speed and the current tension value of the web W is not 0 (zero).

If this difference is 0 (zero), the program proceeds to Step Pa93 to be described later. If the difference is not 0 (zero), the current diameter of the web roll 13 is loaded from the remaining paper length meter 81, and stored in Step Pa85. Then, in Step Pa86, a correction value for a braking force is computed from the difference between the set tension value at the constant speed and the current tension value of the web W and the current diameter of the web roll 13, and the correction value is stored. Then, in Step Pa87, a necessary braking force is loaded from the necessary braking force memory 66.

Then, in Step Pa88, the computed correction value for the braking force is added to the loaded necessary braking force to calculate a new necessary braking force, and the new necessary braking force is stored in the necessary braking force memory 66. Then, in Step Pa89, the braking force at the time of control switching is loaded from the control switching braking force memory 58.

Then, in Step Pa90, it is determined whether the computed necessary braking force is equal to or lower than the loaded braking force at the time of control switching. If the computed necessary braking force is equal or lower, an output value to the accelerating motor driver 22A is computed from the computed necessary braking force and stored in Step Pa91. Then, in Step Pa92, the computed output value to the accelerating motor driver 22A is outputted to the accelerating motor driver 22A. The output value to the electro-pneumatic regulator 18A is such a value that the air brake 14A can supply a braking force by an amount obtained by subtracting the maximum value of the regenerative braking force of the accelerating motor from the necessary braking force, namely, by the difference between the necessary braking force and the maximum value of the regenerative braking force of the accelerating motor 15A. The output value to the accelerating motor driver 22A is such a value that the regenerative braking force of the accelerating motor 15A becomes maximal. Then, in Step Pa93, it is determined whether a cutter command at the time of web splicing, or a sudden stop command, or a speed reduction command has been inputted from the control device 30 of the printing press. If any of the commands has been inputted, the program proceeds to Step Pa98 to be described later. If no such command has been inputted, the program returns to Step Pa29.

If the computed necessary braking force is greater than the loaded braking force at the time of control switching in Step Pa90, an output value to the electro-pneumatic regulator 18A is computed from the computed necessary braking force and stored in Step Pa94. Then, in Step Pa95, the computed output value to the electro-pneumatic regulator 18A is outputted to the electro-pneumatic regulator 18A. Then, in Step Pa96, an output value to the accelerating motor driver 22A is computed from the computed necessary braking force and stored. Then, in Step Pa97, the computed output value to the accelerating motor driver 22A is outputted to the accelerating motor driver 22A. Then, the program proceeds to Step Pa93.

Then, in Step Pa98, it is determined whether a cutter command at the time of web splicing has been inputted. If the cutter command has been inputted, a maximum value of a braking force is loaded from the braking force maximum value memory 63 in Step Pa99. Then, in Step Pa100, the loaded maximum value of the braking force is stored in the necessary braking force memory 66. Then, in Step Pa101, the necessary braking force is loaded from the necessary braking force memory 66, where after the braking force at the time of control switching is loaded from the control switching braking force memory 58 in Step Pa102.

If a cutter command at the time of web splicing has not been inputted in Step Pa98, it is determined in Step Pa103 whether a sudden stop command has been entered. If the sudden stop command has been entered, the set tension value at a sudden stop is loaded from the sudden stop set tension value memory 64 in Step Pa104. Then, in Step Pa105, the current diameter of the web roll 13 is loaded from the remaining paper length meter 81 and stored. Then, in Step Pa106, a necessary braking force is computed from the set tension value at a sudden stop and the current diameter of the web roll 13 and stored. Then, the program proceeds to Step Pa102.

If the sudden stop command has not been entered in Step Pa103, the set tension value at the time of speed reduction is loaded from the speed reduction set tension value memory 65 in Step Pa107. Then, in Step Pa108, the current diameter of the web roll 13 is loaded from the remaining paper length meter 81 and stored. Then, in Step Pa109, a necessary braking force is computed from the set tension value at the time of speed reduction and the current diameter of the web roll 13, and the necessary braking force is stored. Then, the program proceeds to Step Pa102.

Then, in Step Pa110, it is determined whether the computed necessary braking force is equal to or lower than the loaded braking force at the time of control switching. If the computed necessary braking force is equal or lower, an output value to the accelerating motor driver 22A is computed from the computed necessary braking force and stored in Step Pa111. Then, in Step Pa112, the computed output value to the accelerating motor driver 22A is outputted to the accelerating motor driver 22A. Thus, the actions for tension control end.

If the computed necessary braking force is greater than the loaded braking force at the time of control switching in Step Pa110, an output value to the electro-pneumatic regulator 18A is computed from the computed necessary braking force and stored in Step Pa113. Then, in Step Pa114, the computed output value to the electro-pneumatic regulator 18A is outputted to the electro-pneumatic regulator 18A. Then, in Step Pa115, an output value to the accelerating motor driver 22A is computed from the computed necessary braking force and stored. Then, in Step Pa116, the computed output value to the accelerating motor driver 22A is outputted to the accelerating motor driver 22A. Thus, the actions for tension control end. The output value to the electro-pneumatic regulator 18A is such a value that the air brake 14A can supply a braking force by an amount obtained by subtracting the maximum value of the regenerative braking force of the accelerating motor from the necessary braking force, namely, by the difference between the necessary braking force and the maximum value of the regenerative braking force of the accelerating motor 15A. The output value to the accelerating motor driver 22A is such a value that the regenerative braking force of the accelerating motor 15A becomes maximal. If the necessary braking force is greater than the braking force at the time of switching control, the output value to the accelerating motor driver 22A is set at such a value that the regenerative braking force of the accelerating motor 15A becomes maximal, and the output value to the electro-pneumatic regulator 18A is set at such a value that the air brake 14A can supply a braking force by an amount obtained by subtracting the maximum value of the regenerative braking force of the accelerating motor from the necessary braking force, namely, by the difference between the necessary braking force and the maximum value of the regenerative braking force of the accelerating motor 15A. By so doing, the braking force of the air brake 14A to be used can be minimized, deterioration of the surface of the brake pad 17 and its carbonization due to heat generation can be kept to a minimum, so that the frequency of replacement can be minimized.

According to the present embodiment, as described above, with respect to the spindle shafts 12*a*, 12*b* on both sides, which hold the web roll 13, the air brake 14A or 14B is constituted on the side of one spindle shaft 12*a*, while the accelerating motor 15A or 15B is tied to the other spindle shaft 12*b* via the timing pulleys 19*a*, 19*b* and the timing belt 20. In this manner, the regenerative braking force is transmitted from the accelerating motor 15A or 15B.

If the diameter of the web roll 13 is small at an increased speed, at a constant speed, at a reduced speed, or at a sudden stop, a brake is applied only to the accelerating motor 15A or 15B on one shaft side (one end side). If the diameter of the web roll 13 is large and a motor torque is insufficient, the air brake 14A or 14B is concomitantly used, whereby a brake is applied on both shaft sides (opposite end side).

Thus, if a timing pulley ratio is rendered high, a high torque can be generated by the low capacity motor 15A or 15B. Moreover, the accelerating motor 15A or 15B may be an existing motor, and provides a cost advantage. That is, the accelerating motor 15A or 15B can be used not only for tension control, but also for acceleration of the new web roll 13 during web splicing and for unwinding of the remaining web after web splicing.

Furthermore, the regenerative braking force by the accelerating motor 15A or 15B is mainly used for tension control. Thus, the control torque can be stabilized, and an abnormal sound can be prevented. A shortfall in torque caused by the motor torque at an increased speed, at a constant speed, at a reduced speed, or at a sudden stop can be covered by the air brake 14A or 14B. Thus, the accelerating motors 15A, 15B and the air brakes 14A, 14B can be downsized, thus resulting in an inexpensive configuration.

Besides, at an increased speed, at a constant speed, at a reduced speed, or at a sudden stop, the accelerating motor 15A or 15B is mainly used, while the air brake 14A or 14B is used as an aid. Thus, the frequency of use of the air brake 14A or 14B is decreased, and the frequency of replacement of the brake pads 17 can be decreased. That is, the time of replacement work during periodical inspection can be markedly cut, and the efficiency of operating the machine can be increased. On this occasion, the braking force (constant value) at the time of control switching may be set at the maximum value of the regenerative braking force of the accelerating motor 15A or 15B. By so doing, the frequency of use of the air brake 14A or 14B can be decreased further, and this is preferred.

As a result, there is no influence of changes over time, and the reproducibility of control torque is satisfactory. Moreover, low torque control, which is difficult with the air brake 14A or 14B, can be exercised and, even at a time when the diameter of the web roll 13 is small, stable tension control can be performed. Particularly, the accelerating motor 15A or 15B is used for tension control, whereby the event that output torque at the time of tension control varies according to different machines can be avoided.

EMBODIMENT 2

FIGS. 16 to 21 are action flow charts for a tension control device showing Embodiment 2 of the present invention.

This is an embodiment in a case where the capacity of the accelerating motor 15A or 15B is relatively high, and its regenerative braking force has been found to be equal to or greater than the maximum value (constant value) of a braking force required for tension control at an increased speed or a constant speed. In this case, according to the present embodiment, a decision action for control switching between motor regenerative brake torque control ⇔(motor regenerative brake torque control +air brake torque control) is not performed, but regenerative brake torque control by the accelerating motor 15A or 15B is directly performed.

Thus, the action flow charts of FIGS. 16 to 21 are different from the action flow charts of FIGS. 8 to 13 in Embodiment 1 in terms of the actions of Steps Pb57 to Pb79. The actions of Steps Pb1 to Pb56 are the same as the actions of Steps Pa1 to Pa56 in Embodiment 1, and the actions of Steps Pb80 to Pb98 are the same as the actions of Steps Pa98 to Pa116.

Thus, only the actions of Steps Pb57 to Pb79 will be described, and explanations for the actions of Steps Pb1 to Pb56 and the actions of Steps Pb80 to Pb98 are omitted.

In Step Pb56, it is determined whether the computed absolute value of the difference between the previous rotational speed of the printing press and the current rotational speed of the printing press is greater than the tolerance of the absolute value of the difference between the previous rotational speed of the printing press and the current rotational speed of the printing press. If the computed absolute value is greater than the tolerance, the set tension value at the time of speed increasing is loaded from the speed increasing set tension value memory 57 in Step Pb57. Then, in Step Pb58, the current diameter of the web roll 13 is loaded from the remaining paper length meter 81 and stored. Then, in Step Pb59, a necessary braking force is computed from the set tension value at the time of speed increasing and the current diameter of the web roll 13, and the necessary braking force is stored. Then, in Step Pb60, an output value to the accelerating motor driver 22A is computed from the computed necessary braking force and stored. Then, in Step Pb61, the computed output value to the accelerating motor driver 22A is outputted to the accelerating motor driver 22A. Then, in Step Pb62, it is determined whether a cutter command at the time of web splicing, or a sudden stop command, or a speed reduction command has been inputted from the control device 30 of the printing press. If any of the commands has been inputted, the program proceeds to Step Pb80. If no such command has been inputted, the program returns to Step Pb29.

If the computed absolute value is smaller than the tolerance in Step Pb56, the set tension value at the constant speed is loaded from the constant speed set tension value memory 59 in Step Pb63. Then, in Step Pb64, the current diameter of the web roll 13 is loaded from the remaining paper length meter 81 and stored. Then, in Step Pb65, a necessary braking force is computed from the set tension value at the constant speed and the current diameter of the web roll 13, and the necessary braking force is stored. Then, in Step Pb66, an output value to the accelerating motor driver 22A is computed from the computed necessary braking force and stored. Then, in Step Pb67, the computed output value to the accelerating motor driver 22A is outputted to the accelerating motor driver 22A. Then, in Step Pb68, the set tension value at the constant speed is loaded from the constant speed set tension value memory 59.

Then, in Step Pb69, an output from the A/D converter 84 for the tension detecting means 25 is loaded. Then, in Step Pb70, the current tension value of the web W is computed from the loaded output from the A/D converter 84 for the tension detecting means 25, and stored. Then, in Step Pb71, the difference between the set tension value at the constant speed and the current tension value of the web W is computed and stored. Then, in Step Pb72, it is determined whether the difference between the set tension value at the constant speed and the current tension value of the web W is not 0 (zero).

If this difference is 0 (zero) in Step Pb72, the program proceeds to Step Pb79 to be described later. If the difference is not 0 (zero), the current diameter of the web roll 13 is loaded from the remaining paper length meter 81, and stored in Step Pb73. Then, in Step Pb74, a correction value for a braking force is computed from the difference between the set tension value at the constant speed and the current tension value of the web W and the current diameter of the web roll 13, and the correction value is stored. Then, in Step Pb75, a necessary braking force is loaded from the necessary braking force memory 66.

Then, in Step Pb76, the computed correction value for the braking force is added to the loaded necessary braking force to compute a new necessary braking force, and the new necessary braking force is stored in the necessary braking force memory 66. Then, in Step Pb77, an output value to the accelerating motor driver 22A is computed from the computed necessary braking force and stored. Then, in Step Pb78, the computed output value to the accelerating motor driver 22A is outputted to the accelerating motor driver 22A. Then, in Step Pb79, it is determined whether a cutter command at the time of web splicing, or a sudden stop command, or a speed reduction command has been inputted from the control device 30 of the printing press. If any of the commands has been inputted, the program proceeds to Step Pb80. If no such command has been inputted, the program returns to Step Pb29.

According to the present embodiment, as described above, if the capacity of the accelerating motor 1SA or 15B is ample, regenerative brake torque control is directly exercised for tension control at an increased speed or a constant speed which requires a low regenerative braking force. Thus, in addition to the same actions and effects as those in Embodiment 1, the advantages are produced that the frequency of use of the air brake 14A or 14B is further decreased, and control actions are simplified.

While the present invention has been described by the above embodiments, it is to be understood that the invention is not limited thereby, but may be varied or modified in many other ways. Such variations or modifications are not to be regarded as a departure from the spirit and scope of the invention, and all such variations and modifications as would be obvious to one skilled in the art are intended to be included within the scope of the appended claims.

What is claimed is:

1. A braking force control method for a strip-shaped material feeding device including a braking force control device and arranged to feed a strip-shaped material of a web roll, said strip-shaped material feeding device including web roll support means having a rotating shaft for supporting said web roll, brake means for applying a first braking force in a rotating direction to said rotating shaft, and drive means for applying a drive force in the rotating direction to said rotating shaft and a second braking force in the rotating direction to said rotating shaft, said braking force control method comprising:

applying only the second braking force when a required braking force is smaller than a maximum braking force applicable by said drive means; and applying the first braking force simultaneously with the second braking force when the required braking force is larger than said maximum braking force, such that the brake means applies the first braking force only when the required braking force exceeds the maximum braking force.

2. The braking force control method for a strip-shaped material feeding device according to claim 1, wherein said maximum braking force is equal to or larger than a braking force required for tension control of said strip-shaped material in a routine operation.

3. The braking force control method for a strip-shaped material feeding device according to claim 1, further comprising:

applying the second braking force and applying the first braking force by an amount corresponding to a difference between the required braking force and the maximum braking force when the required braking force is larger than the maximum braking force.

4. The braking force control method for a strip-shaped material feeding device according to claim 3, wherein said strip-shaped material feeding device is a strip-shaped material continuous feeding device for connecting a strip-shaped material of a new web roll to said strip-shaped material being fed, and continuously feeding a strip-shaped material, said brake means is an air brake, and said drive means is a motor of an accelerating device for said new web roll, said accelerating device being arranged to accelerate a peripheral speed of the strip-shaped material of said new web roll to a speed of said strip-shaped material being fed.

5. The braking force control method for a strip-shaped material feeding device according to claim 1, wherein said strip-shaped material feeding device is a strip-shaped material continuous feeding device for connecting a strip-shaped material of a new web roll to said strip-shaped material being fed, and continuously feeding a strip-shaped material, said brake means is an air brake, and said drive means is a motor of an accelerating device for said new web roll, said accelerating device being arranged to accelerate a peripheral speed of the strip-shaped material of said new web roll to a speed of said strip-shaped material being fed.

6. The braking force control method for a strip-shaped material feeding device according to claim 1, wherein the required breaking force is calculated from a diameter of said web roll.

7. The braking force control method for a strip-shaped material feeding device according to claim 1, wherein the required braking force is calculated from a set value of reference tension setting means and a signal from tension detecting means for detecting a tension of said strip-shaped material.

8. A braking force control device of a strip-shaped material feeding device arranged to feed a strip-shaped material of a web roll, said strip-shaped material feeding device comprising web roll support means having a rotating shaft for supporting said web roll, brake means for applying a first braking force in a rotating direction to said rotating shaft, and drive means for applying a drive force in the rotating direction to said rotating shaft and a second braking force in the rotating direction to said rotating shaft, said braking force control device comprising:

a control device which exercises control in such a manner as to, apply only the second braking force when a required braking force for said rotating shaft is smaller than a maximum braking force applicable by said drive means, and apply the first braking force simultaneously with the second braking force when the required braking force is larger than said maximum braking force, such that the brake means applies the first braking force only when the required braking force exceeds the maximum braking force.

9. The braking force control device for a strip-shaped material feeding device according to claim 8, wherein said maximum braking force is equal to or larger than a braking force required for tension control of said strip-shaped material in a routine operation.

10. The braking force control device for a strip-shaped material feeding device according to claim 8, wherein said control device exercises control in such a manner as to apply the second braking force, and apply the first braking force by an amount corresponding to a difference between the required braking force and the maximum braking force when the required breaking force is larger than the maximum braking force.

11. The braking force control device for a strip-shaped material feeding device according to claim 10, wherein said strip-shaped material feeding device is a strip-shaped material continuous feeding device for connecting a strip-shaped material of a new web roll to said strip-shaped material being fed, and continuously feeding a strip-shaped material, said brake means is an air brake, and said drive means is a motor of an accelerating device for said new web roll, said accelerating device being arranged to accelerate a peripheral speed of the strip-shaped material of said new web roll to a speed of said strip-shaped material being fed.

12. The braking force control device for a strip-shaped material feeding device according to claim 8, wherein said strip-shaped material feeding device is a strip-shaped material continuous feeding device for connecting a strip-shaped material of a new web roll to said strip-shaped material being fed, and continuously feeding a strip-shaped material, said brake means is an air brake, and said drive means is a motor of an accelerating device for said new web roll, said accelerating device being arranged to accelerate a peripheral speed of the strip-shaped material of said new web roll to a speed of said strip-shaped material being fed.

13. The braking force control device for a strip-shaped material feeding device according to claim 8, wherein said control device calculates the required breaking force from a signal from web roll diameter detecting means for detecting a diameter of said web roll.

14. The braking force control device for a strip-shaped material feeding device according to claim 8, wherein said control device calculates the required braking force from a set value of reference tension setting means and a signal from tension detecting means for detecting a tension of said strip-shaped material.

* * * * *